US008317949B2

(12) United States Patent
Branagan et al.

(10) Patent No.: US 8,317,949 B2
(45) **Date of Patent: *Nov. 27, 2012**

(54) DUCTILE METALLIC GLASSES

(75) Inventors: Daniel James Branagan, Idaho Falls, ID (US); Brian E. Meacham, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 486 days.

This patent is subject to a terminal disclaimer.

(21) Appl. No.: 12/485,843

(22) Filed: Jun. 16, 2009

(65) Prior Publication Data

US 2010/0065163 A1 Mar. 18, 2010

Related U.S. Application Data

(60) Provisional application No. 61/061,768, filed on Jun. 16, 2008.

(51) Int. Cl.
*C22C 45/02* (2006.01)

(52) U.S. Cl. ..... 148/540; 148/561

(58) Field of Classification Search ..... 148/561; 164/463

See application file for complete search history.

(56) References Cited

U.S. PATENT DOCUMENTS

| | | | | |
|---|---|---|---|---|
| 4,067,732 | A * | 1/1978 | Ray | 148/403 |
| 6,767,419 | B1 | 7/2004 | Branagan | |
| 2004/0140016 | A1 * | 7/2004 | Sakamoto et al. | 148/304 |
| 2005/0252586 | A1 | 11/2005 | Branagan | |

OTHER PUBLICATIONS

Valiev, "Institute of Physics of Advanced Materials," Nature Materials vol. 3, Aug. 2004 (p. 511-516).
ASTM E 2456-06, Standard Terminology Relating to Nanotechnology, 2007.
Gleiter, "Nanocrystalline Materials," Prog. Mater. Sci. 33 (1989), 223-315.
Dao, "Toward a quantitative understanding of mechanical behavior of nanocrystalline metals," Acta Materialia 55 (2007), 4041-4065.
Klement, "Non-crystalline Structure in Solidified Gold-Silicon Alloys," Nature 187 (1960), 869-870.
Johnson, "Bulk Glass-Forming Metallic Alloys: Science and Technology," MRS Bull. 24 (1999), 42-56.
Inoue, "Stabilization of Metallic Supercooled Liquid and Bulk Amorphous Alloys," Acta mater. 48 (2000) 279-306.
Greer, "Bulk Metallic Glasses: At the Cutting Edge of Metals Research," MRS Bulletin 32 (2007), 611.
Jia, "Effects of Nanocrystalline and Ultrafine Grain Sizes on Constitutive Behavior and Shear Bands in Iron," Acta Mater. 51 (2003), 3495-3509.

(Continued)

*Primary Examiner* — George Wyszomierski
(74) *Attorney, Agent, or Firm* — Grossman, Tucke, Perreault & Pfleger, PLLC

(57) ABSTRACT

This application deals with glass forming iron based alloys which when produced as a metallic glass or mixed structure comprising metallic glass and nanocrystalline phases, results in extraordinary combinations of strength and ductility. Specifically, high strain up to 97% and high strength up to 5.9 GPa has been measured. Additionally, consistent with the amorphous structure high elasticity up to 2.6% has been observed. Thus, the new alloys developed result in structures and properties which yield high elasticity corresponding to a metallic glass, high plasticity corresponding to a ductile crystalline metal, and high strength as may be observed in nanoscale materials.

9 Claims, 42 Drawing Sheets

OTHER PUBLICATIONS

Flores, "Mean Stress Effects on Flow Localization and Failure in a Bulk Metallic Glass," Acta mater. 49 (2001) 2527-2537.
Zhao, "Simultaneously Increasing the Ductility and Strength of Nanostructured Alloys," Adv. Mater. 18 (2006), 2280 2283.
Steif, "Strain Localization in Amorphous Metals," Acta Metall. 30 (1982), 447-455.
Zhang, "Modulated oscillatory hardening and dynamic recrystallization in cryomilled nanocrystalline Zn," Acta Mater. 50 (2002), 3995-4004.
Chen, Deformation-induced nanocrystal formation in shear bands of amorphous alloys Nature 367 (1994), 541-543.
Hays, "Microstructure Controlled Shear Band Pattern Formation and Enhanced Plasticity of Bulk Metallic Glasses Containing in situ Formed Ductile Phase Dendrite Dispersions," Phys. Rev. Lett. 84 (2000), 2901-2904.
Yim, "Bulk metallic glass matrix composites," Appl. Phys. Lett. 71 (1997), 3808-3810.
Szuecs, "Mechanical Properties of Zr56.2 Ti13.8 Nb5.0 Cu6.9 Ni5.6 Be12.5 Ductile Phase Reinforced Bulk Metallic Glass Composite," Acta Mater. 49 (2001) 1507-1513.
Yavari, "FeNiB-based metallic glasses with fcc crystallisation products," Journal of Non-Crystalline Solids 304 (2002) 44-50.
Fan,"Metallic glass matrix composite with precipitated ductile reinforcement," Appl. Phys. Lett. 81 (2002) 1020-1022.
Wang et al., "High tensile ductility in a Nanostructured Metal," Letters to Nature vol. 419, Oct. 31, 2002 (p. 912-915).
Lee, "Effect of a controlled volume fraction of dendritic phases on tensile and compressive ductility in La-based metallic glass matrix composites," Acta Materialia 52 (2004) 4121-4131.
Wada, "Enhancement of room-temperature plasticity in a bulk metallic glass by finely dispersed porosity," Applied Physics Letters 86, 251907 (2005).
Saida, "Nanoscale multistep shear band formation by deformation~induced nanocrystallization in Zr-Al-Ni-Pd bulk metallic glass," Applied Physics Letters 87, 151907 (2005).
Lee et al., "Crystallization-induced plasticity of Cu-Zr containing bulk amorphous alloys," Acta Materialia 54 (2006) 349-355.
Fan, "Ductility of bulk nanocrystalline composites and metallic glasses at room temperature,"Appl. Phys. Lett. 77 (2000) 46-48.
Kim, "Role of nanometer-scale quasicrystals in improving the mechanical behavior of Ti-based bulk metallic glasses," Appl. Phys. Lett. 83 (2003) 3093-3095.
Das, "'Work-Hardenable' Ductile Bulk Metallic Glass," Phys. Rev. Lett. 94 (2005) 205501 (4 Pages).
Lu et al., "Ultrahigh strenght and high electrical conductivity in copper," Science, vol. 304, Apr. 16, 2004 (p. 422-426).
Kim, "Heterogeneity of a CU47.5Zr47.5AI5 bulk metallic glass" Applied Physics Letters 88,051911 (2006) (3 Pages).
Yao, "Superductile bulk metallic glass," Applied Physics Letters 88, 122106 (2006) (3 Pages).
Kim, "Work hardening ability of ductile Ti45Cu40Ni7.5Zr5Sn2.5 and CU47.5Zr47.5AI5 bulk metallic glasses," Applied Physics Letters 89, 071908 (2006) (3 Pages).
Chen et al., "Extraordinary Plasticity of Ductile Bulk Metallic Glasses," PRL 96, 245502 (2006).
Chen, "Free-volume-induced enhancement of plasticity in a monolithic bulk metallic glass at room temperature," Scripta Materialia 59 (2008) 75-78.
Hofmann, "Designing metallic glass matrix composites with high toughness and tensile ductility," Nature 451 (2008) 1085 (6 pages).
Schroers, et al., "Ductile Bulk Metallic Glass," PRL 93, 255506 (2004) (4 pages).
Flores N , "Local heating associated with crack tip plasticity in Zr-Ti-Ni-Cu-Be bulk amorphous metals," J. Mater. Res., vol. 14, No.3, Mar. 1999, p. 638-643.
Liu, et al., "Super Plastic Bulk Metallic Glasses at Room Temperature," Science vol. 315, Mar. 9, 2007, pp. 1385-1388.
International Search Report and Written Opinion dated Aug. 28, 2009 issued in related International Patent Application No. PCT/US09/47561.
Xing, "Enhanced plastic strain in Zr-based bulk amorphous alloys," Physical Review B, vol. 64, 180201 (2001) 4 pages.
Kato et al., "Synthesis and Mechanical Properties of Bulk Amorphous Zr-AI-Ni-Cu Alloys Containing ZrC Particles," Material Translations Online vol. 38 No. 09 (1997) (1 page).
Chinese Office Action dated Apr. 1, 2012 issued in related Chinese Patent Application No. 200980127564.9 (5 pages).

* cited by examiner

DUCTILE METALLIC GLASSES

CROSS-REFERENCE TO RELATED APPLICATIONS

This application claims the benefit of U.S. Provisional Application No. 61/061,768 filed Jun. 16, 2008, the teachings of which are incorporated by reference.

FIELD OF INVENTION

The present disclosure relates to iron based alloys, to ductile metallic glasses that result in relatively high strength, high elastic elongation, and high plastic elongation and to a method for making same.

BACKGROUND

Metallic nanocrystalline materials and metallic glasses may be considered to be special classes of materials known to exhibit relatively high hardness and strength characteristics. Due to their potential, they are considered to be candidates for structural applications. However, these classes of materials may exhibit limited fracture toughness associated with the rapid propagation of shear bands and/or cracks, which may be a concern for the technological utilization of these materials. While these materials may show adequate ductility by testing in compression, when testing in tension these materials may show elongations close to zero and in the brittle regime. The inherent inability of these classes of material to be able to deform in tension at room temperature may be a limited factor for some potential structural applications where intrinsic ductility is needed to avoid catastrophic failure.

In some cases, nanocrystalline materials may be understood as polycrystalline structures with a mean grain size below 500 nm including, in some cases, a mean grain size below 100 nm. Despite their relatively attractive properties (high hardness, yield stress and fracture strength), nanocrystalline materials may generally show a disappointing and relatively low tensile elongation and mat tend to fail in an extremely brittle manner. In fact, the decrease of ductility for decreasing grain sizes has been known for a long time as attested, for instance, by the empirical correlation between the work hardening exponent and the grain size proposed by others for cold rolled and conventionally recrystallized mild steels. As the grain size progressively decreases, the formation of dislocation pile-ups may become more difficult, limiting the capacity for strain hardening, which may lead to mechanical instability and cracking under loading.

SUMMARY

The present invention relates to a metallic alloy comprising:

at least 35 atomic % iron, preferably 35 atomic % iron to 92 atomic % iron;

nickel and/or cobalt present in the range of 7 atomic % to 50 atomic %; and at least one element selected from the group consisting of boron, carbon, silicon, phosphorous and nitrogen present in the range of 1 atomic % to 35 atomic %; wherein said atomic percents are selected to provide 95 atomic percent for a given alloy.

According to another aspect the present invention relates to a ductile metallic material made of an alloy as defined above being a metallic glass, a nanocrystalline material or a mixture thereof exhibiting at least one glass to crystalline transformation measured by differential scanning calorimetry (DSC) at a heating rate of 10° C./min.

The metallic material of the present invention may exhibit an elasticity of up to 3%, a strain of greater than 0.5%, a failure strength in the range of 1 GPa to 5.9 GPa and a Vickers hardness (HV300) of 9 GPa to 15 GPa.

According to a further aspect the present invention relates to a method of forming a ductile metallic material comprising:

providing a glass forming iron based metallic alloy comprising: at least 35 atomic % iron, preferably 35 atomic % iron to 92 atomic % iron;

nickel and/or cobalt present in the range of 7 atomic % to 50 atomic %; and at least one element selected from the group consisting of boron, carbon, silicon, phosphorous and nitrogen present in the range of 1 atomic % to 35 atomic %; wherein said atomic percent are selected to provide 95 atomic percent for a given alloy;

melting said glass forming iron based metallic alloy;

forming said glass forming alloy and cooling said alloy at a rate of $10^2$ to $10^6$ K/s obtaining a material comprising a metallic glass, a nanocrystalline material or a mixture thereof.

BRIEF DESCRIPTION OF DRAWINGS

The above-mentioned and other features of this disclosure, and the manner of attaining them, may become more apparent and better understood by reference to the following description of embodiments described herein taken in conjunction with the accompanying drawings, wherein:

FIG. 5*a*) illustrates Alloy 12 melt-spun at 10.5 m/s, and FIG. 5*b*) illustrates Alloy 13 melt-spun at 10.5 m/s.

DETAILED DESCRIPTION

Figure 1A:
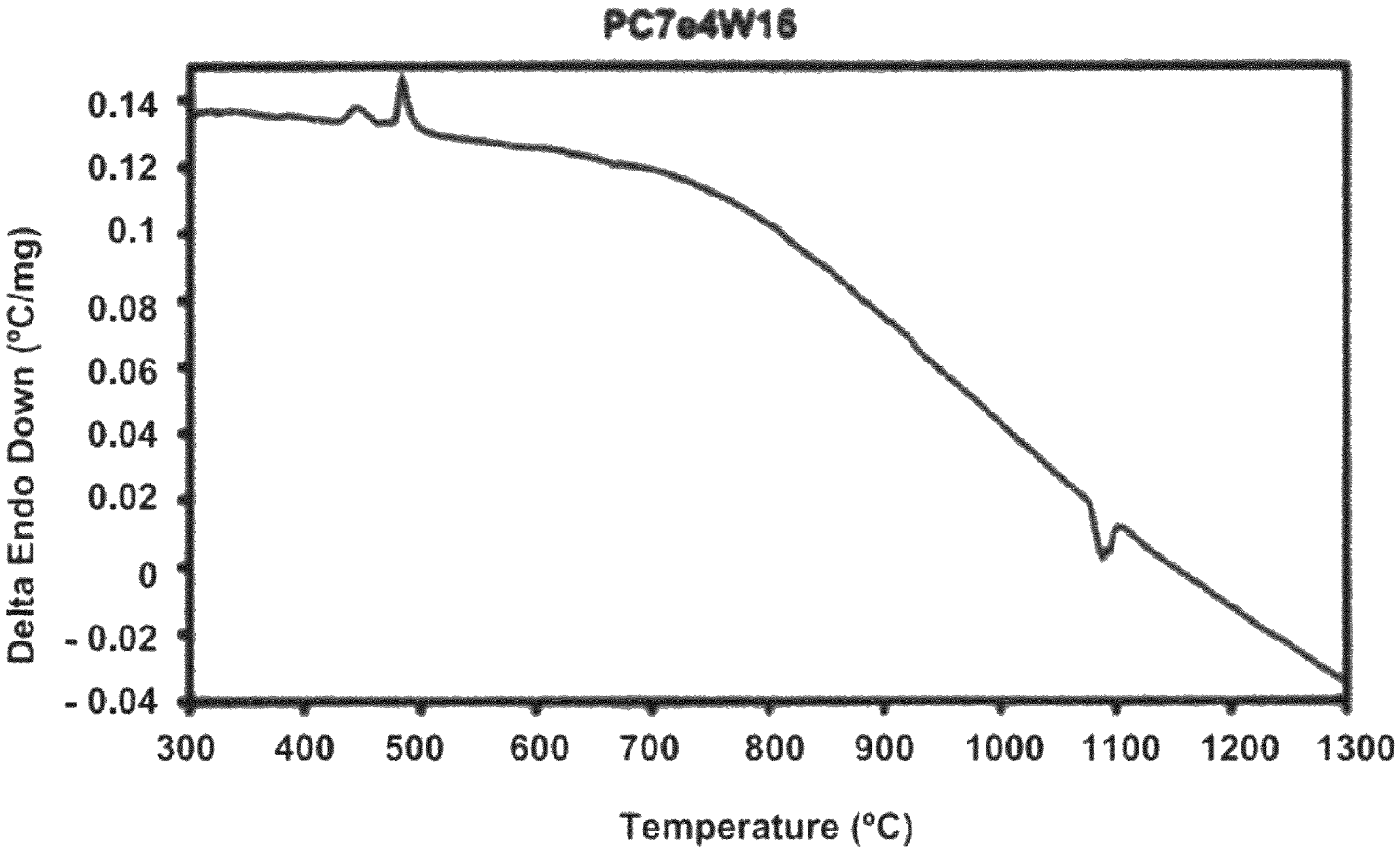
FIGS. 1*a* through 1*f* illustrate DTA curves of the alloys showing the presence of glass to crystalline transformation peak(s) and melting peak(s); wherein FIG. 1*a*) illustrates Alloy 1 melt-spun at 16 m/s, FIG. 1*b*) illustrates Alloy 4 melt-spun at 16 m/s, FIG. 1*c*) illustrates Alloy 2 melt-spun at 16 m/s, FIG. 1*d*) illustrates Alloy 5 melt-spun at 16 m/s, FIG. 1*e*) illustrates ALLOY 3 melt-spun at 16 m/s, and FIG. 1*f*) illustrates Alloy 6 melt-spun at 16 m/s.
Figure 1B:
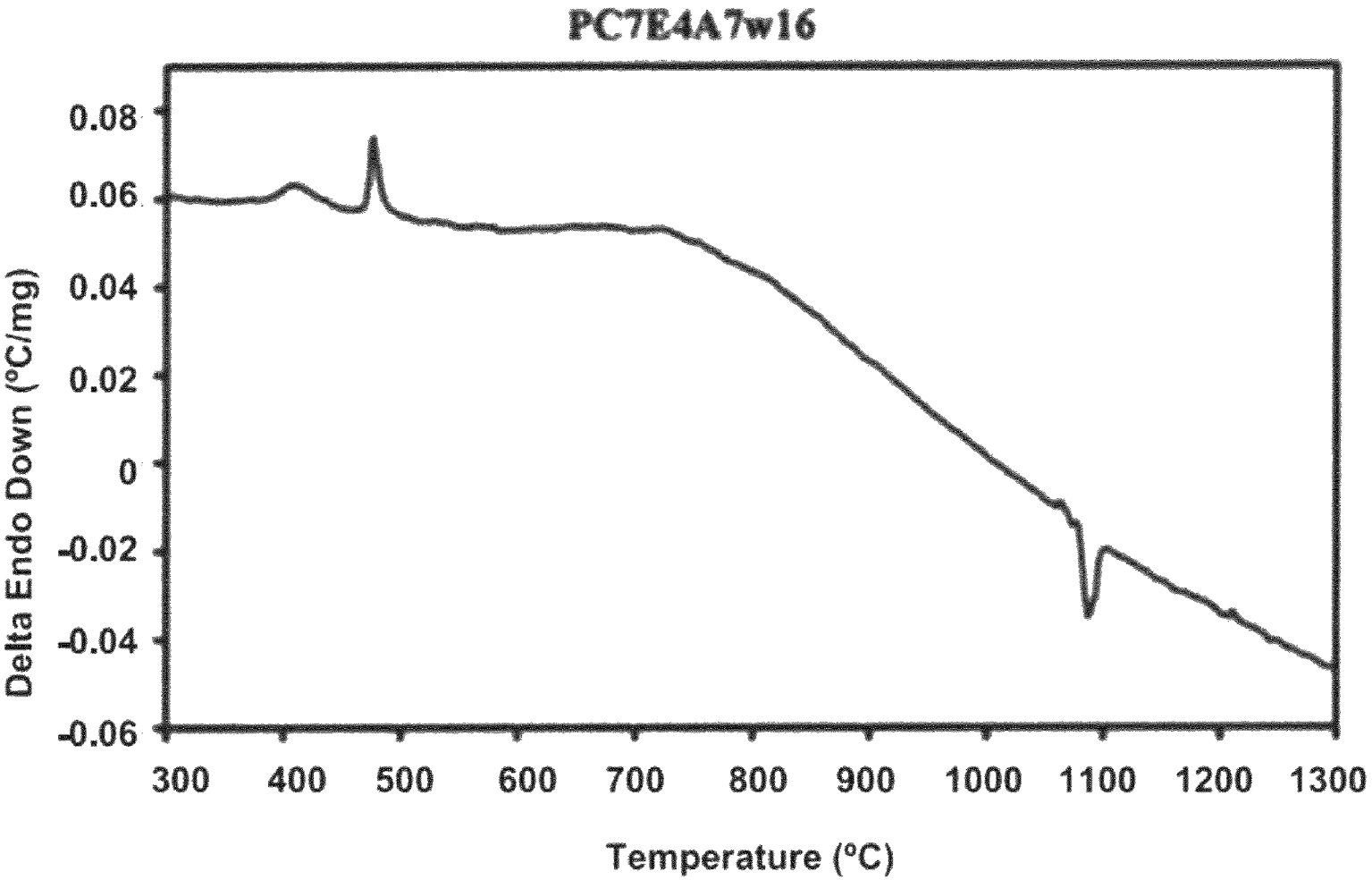
Figure 1C:
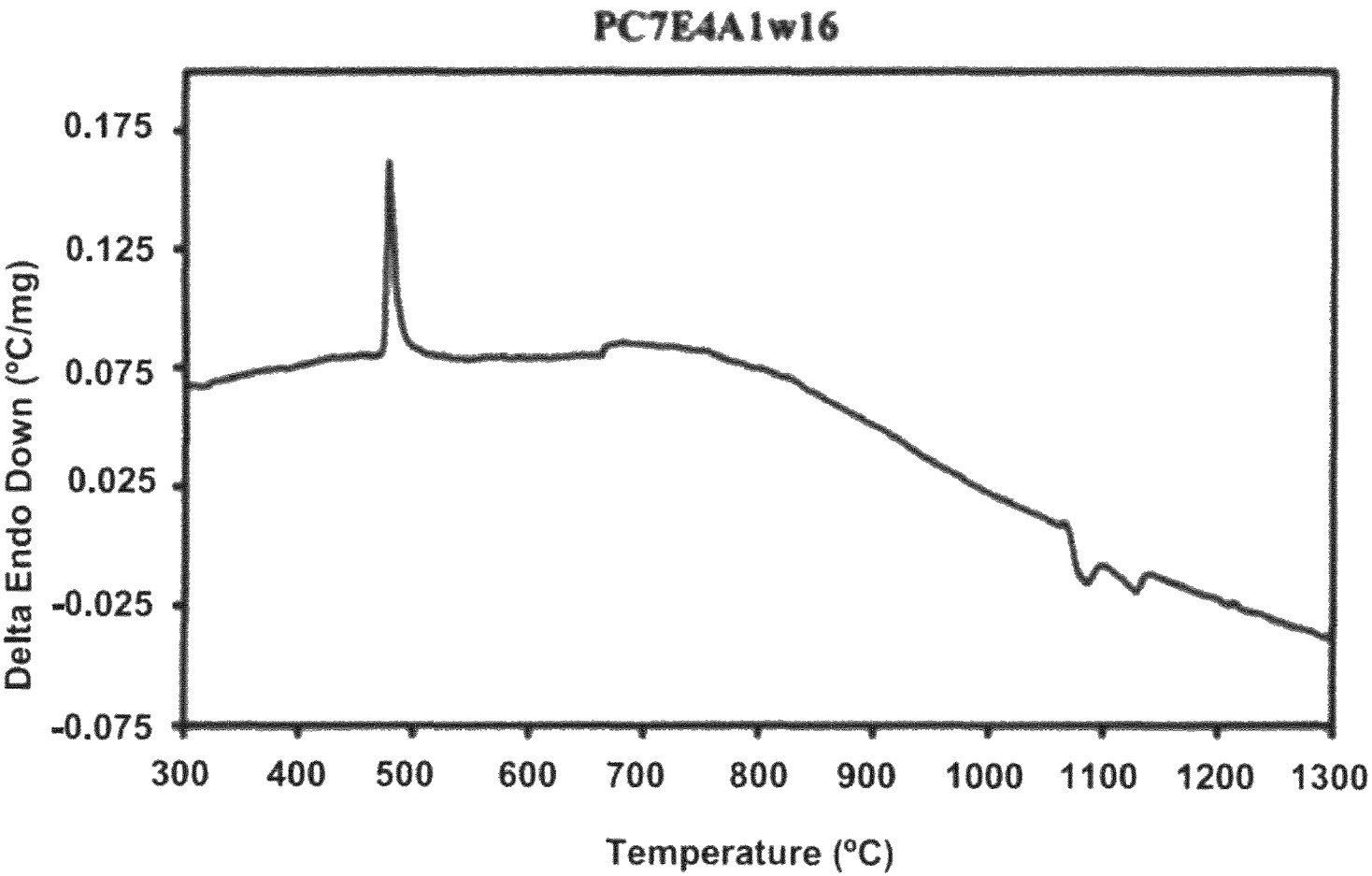
Figure 1D:
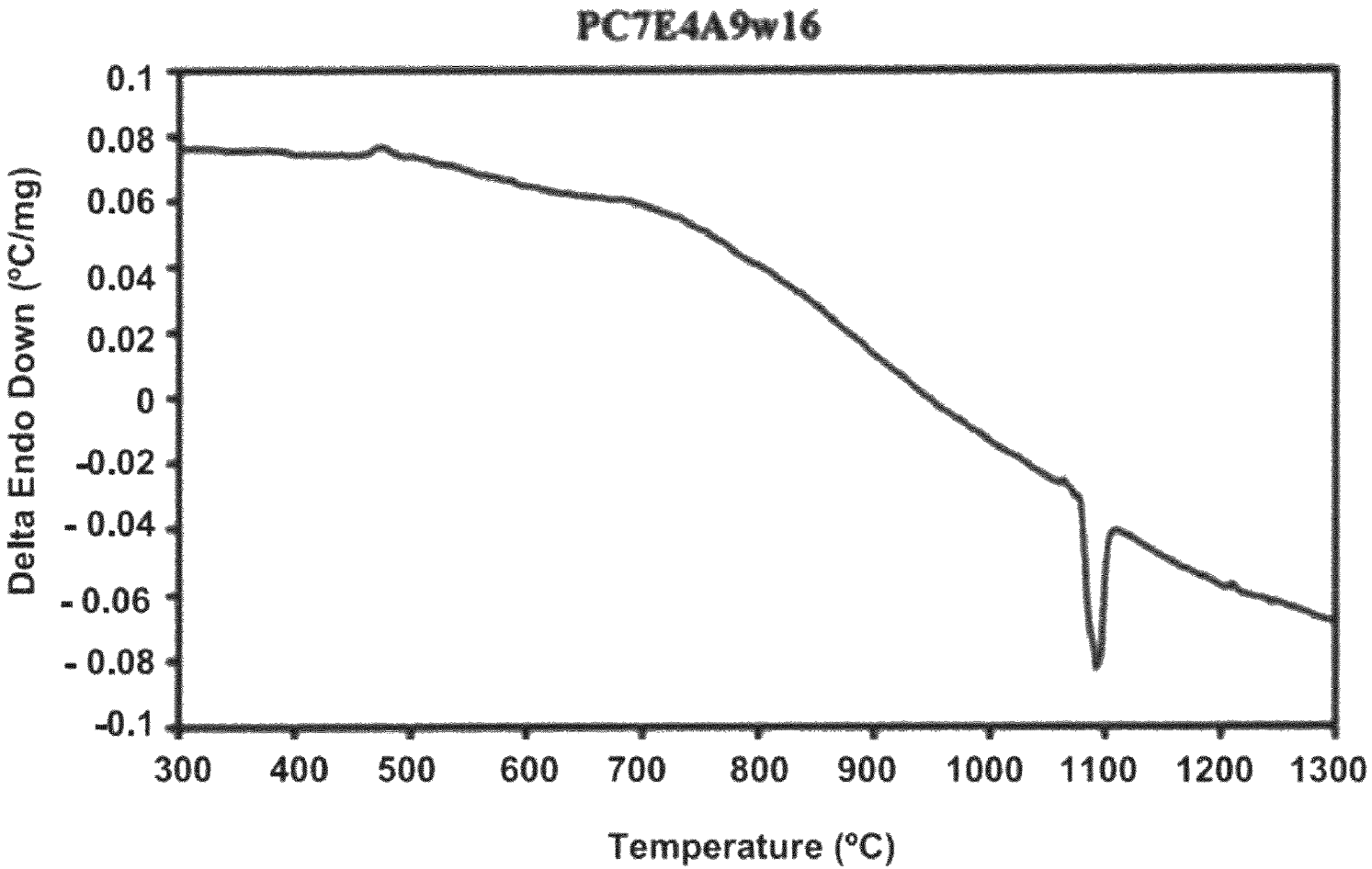
Figure 1E:
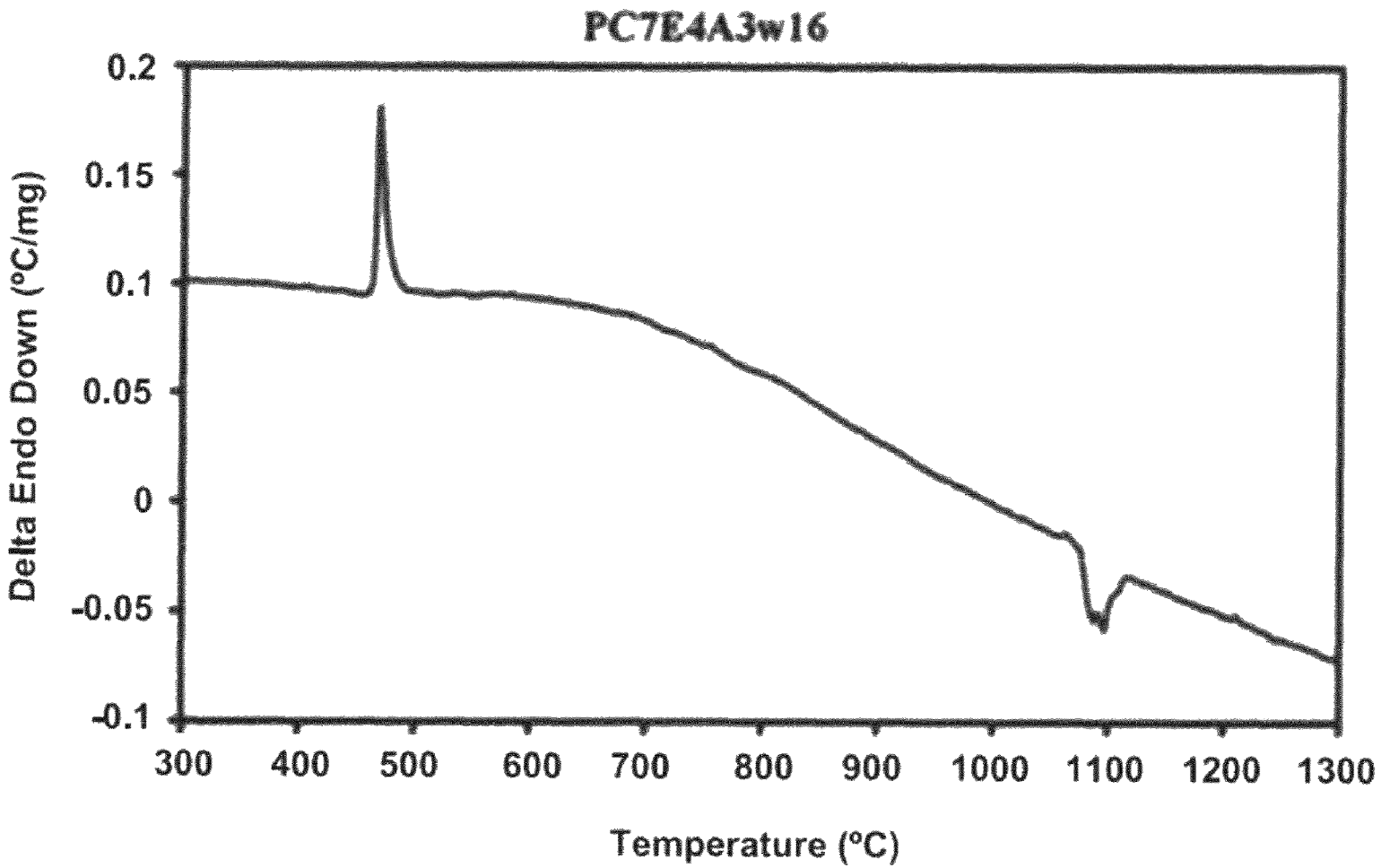
Figure 1F:
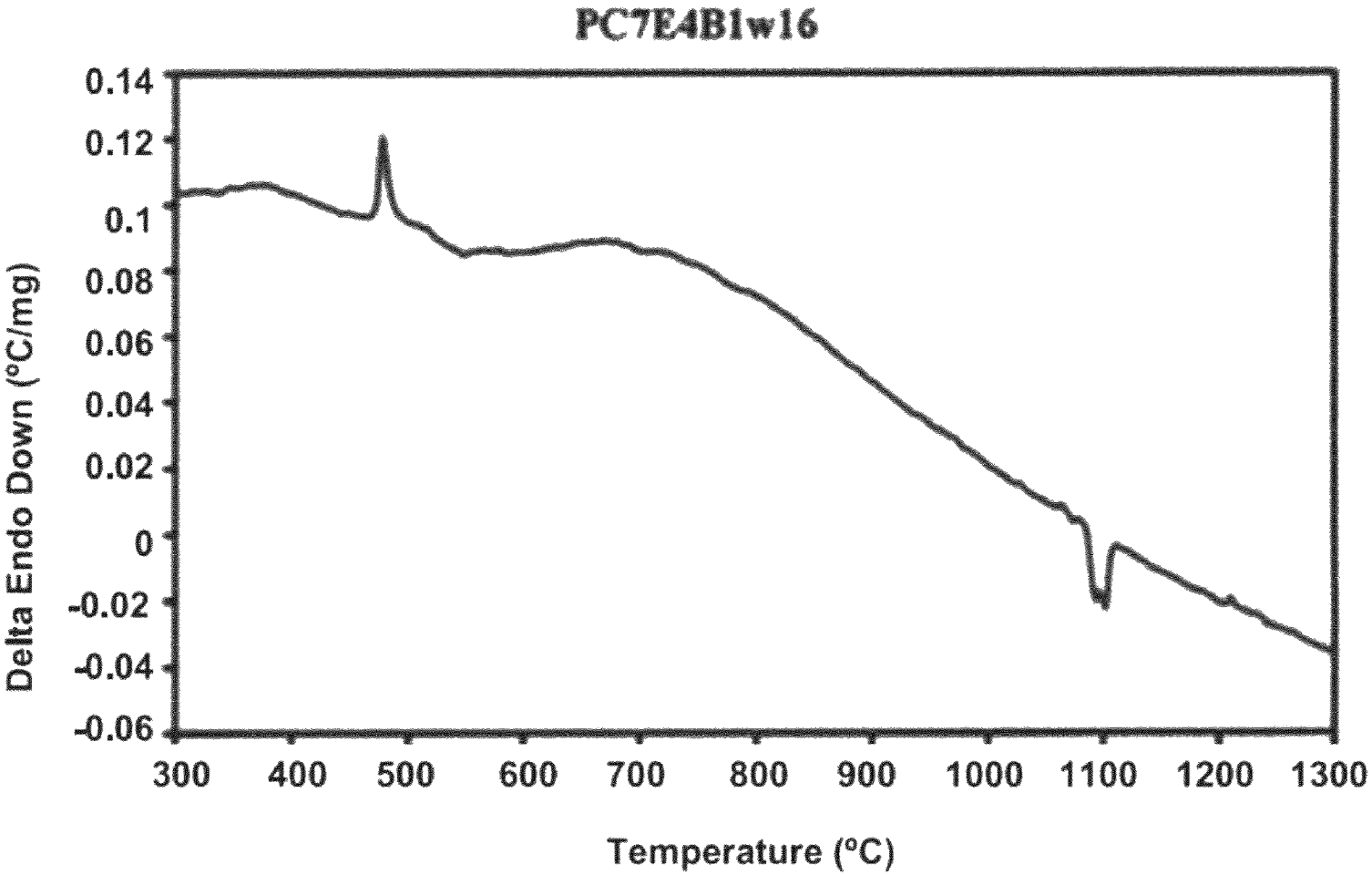
Figure 2A:
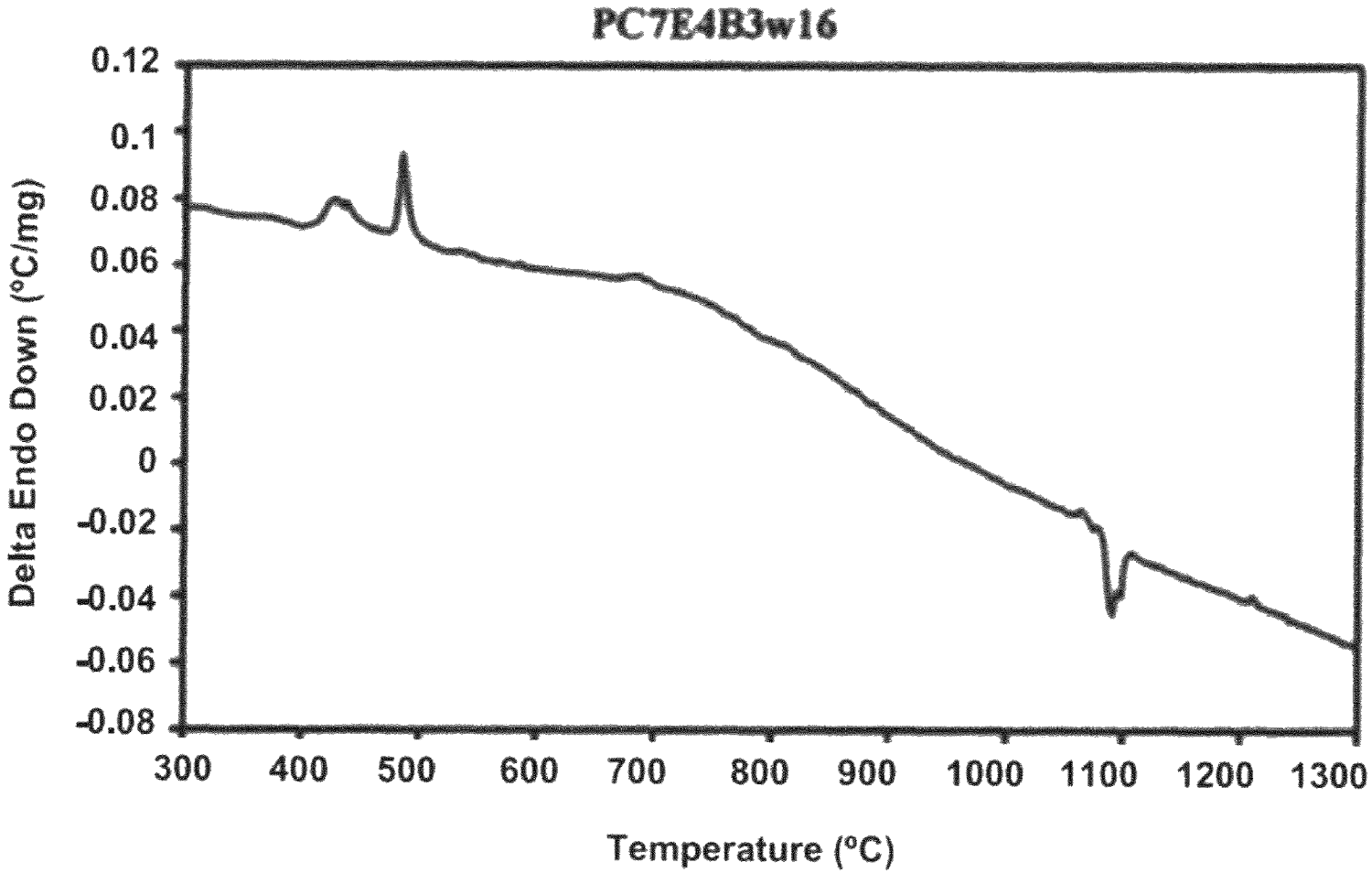
FIGS. 2*a* through 2*f* illustrate DTA curves of the alloys showing the presence of glass to crystalline transformation peak(s) and melting peak(s); wherein FIG. 2*a*) illustrates Alloy 7 melt-spun at 16 m/s, FIG. 2*b*) illustrates Alloy 10 melt-spun at 16 m/s, FIG. 2*c*) illustrates Alloy 8 melt-spun at 16 m/s, FIG. 2*d*) illustrates Alloy 11 melt-spun at 16 m/s, FIG. 2*e*) illustrates ALLOY 9 melt-spun at 16 m/s, and FIG. 2*f*) illustrates Alloy 12 melt-spun at 16 m/s.
Figure 2B:
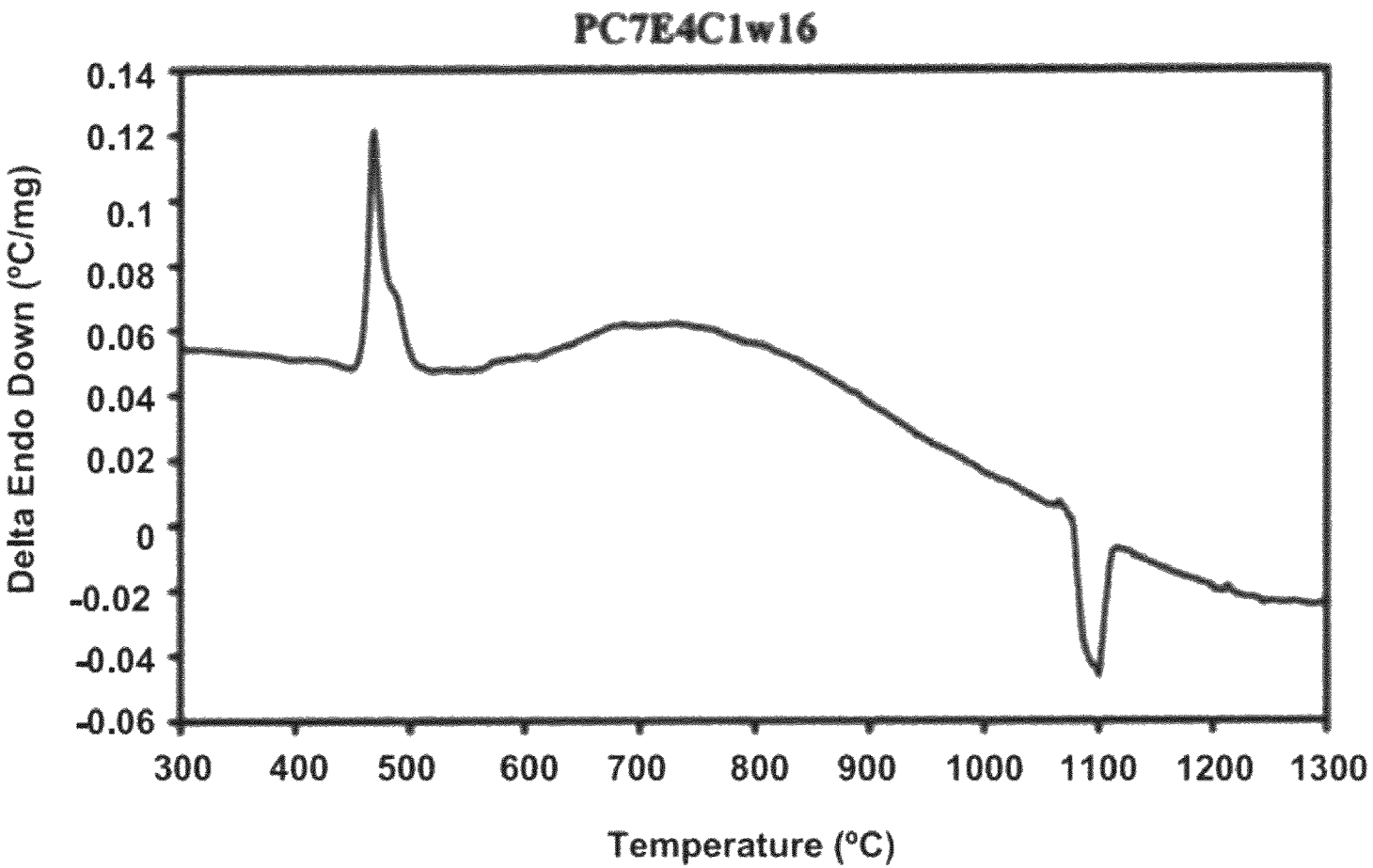
Figure 2C:
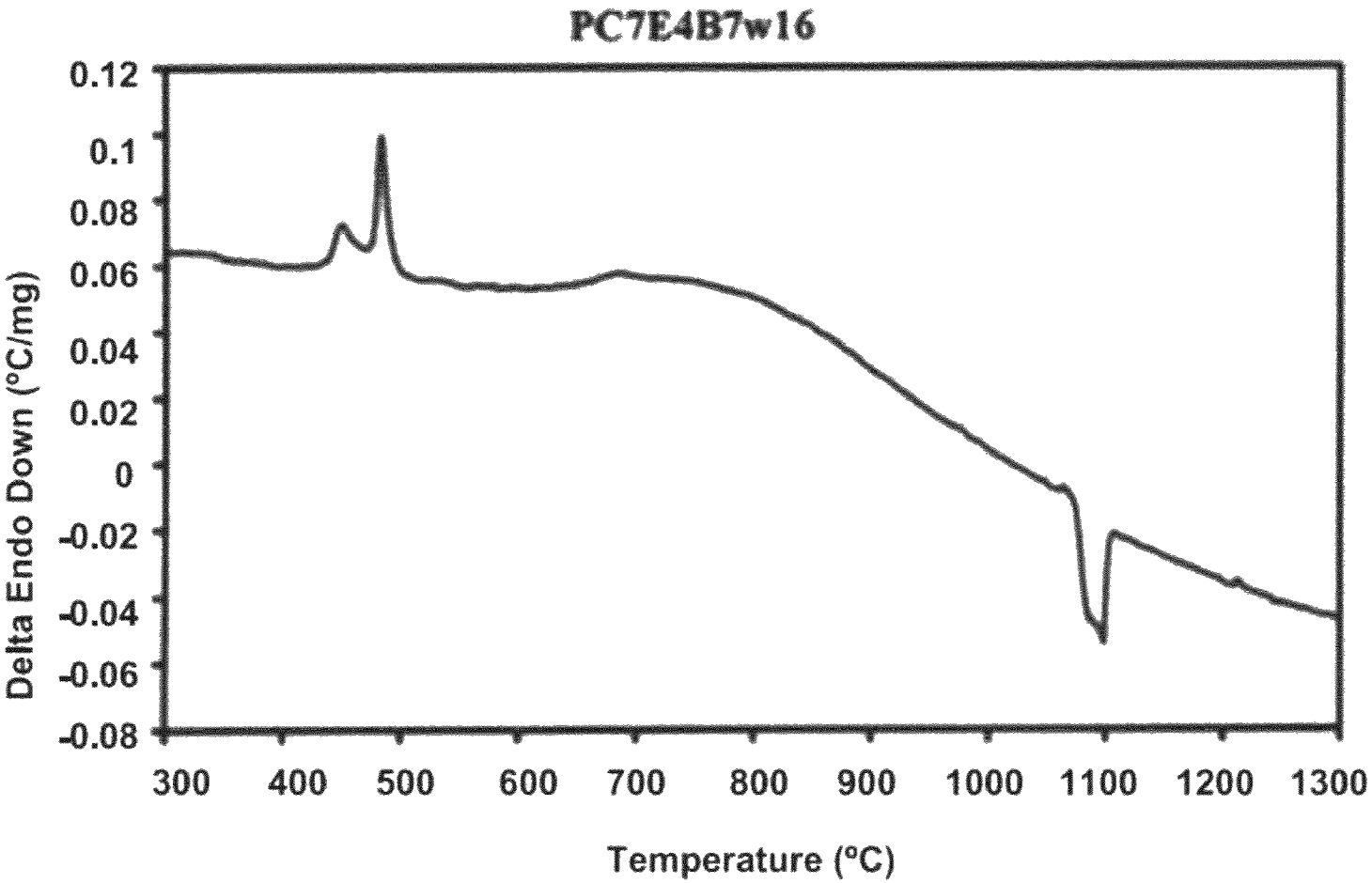
Figure 2D:
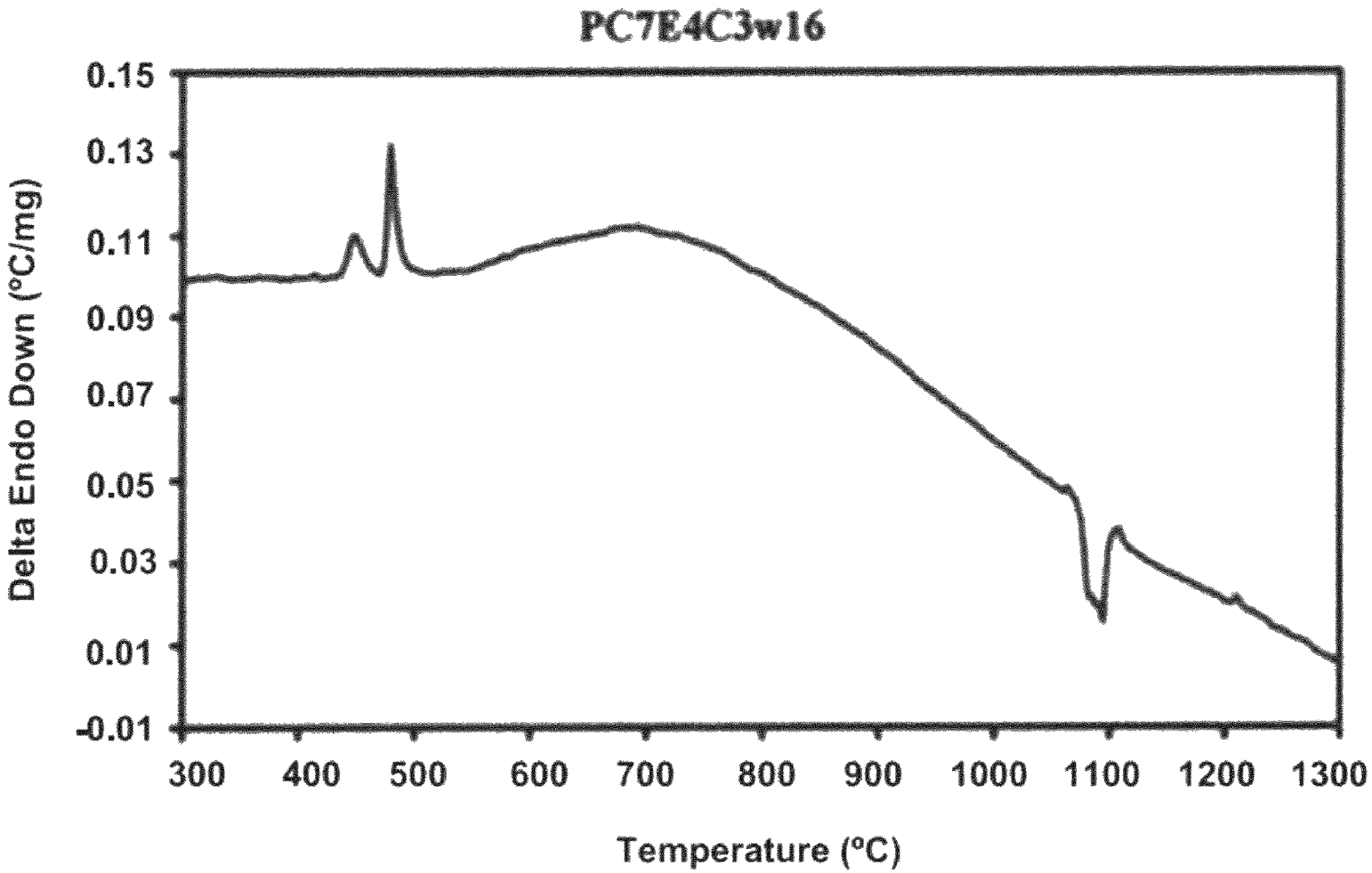
Figure 2E:
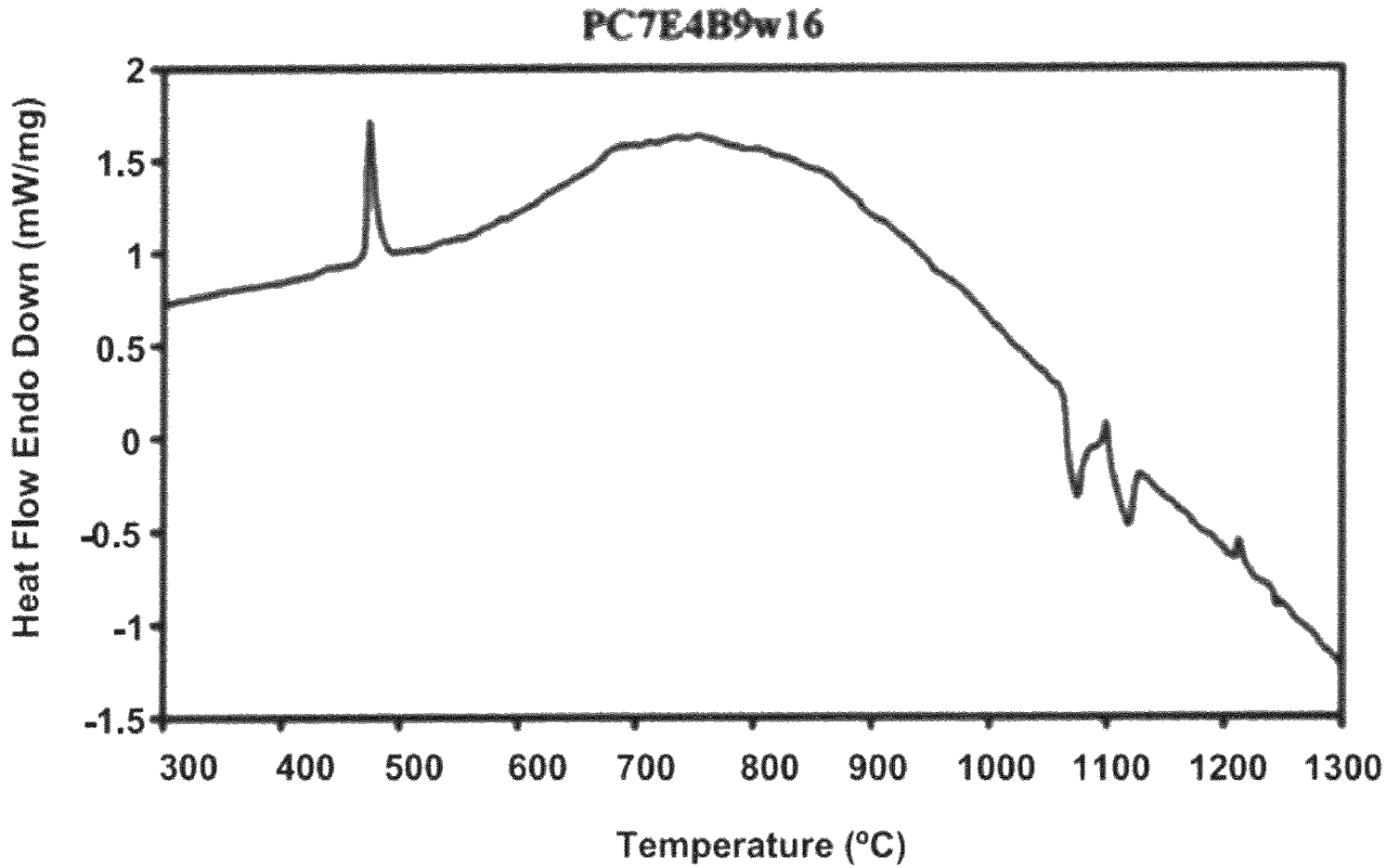
Figure 2F:
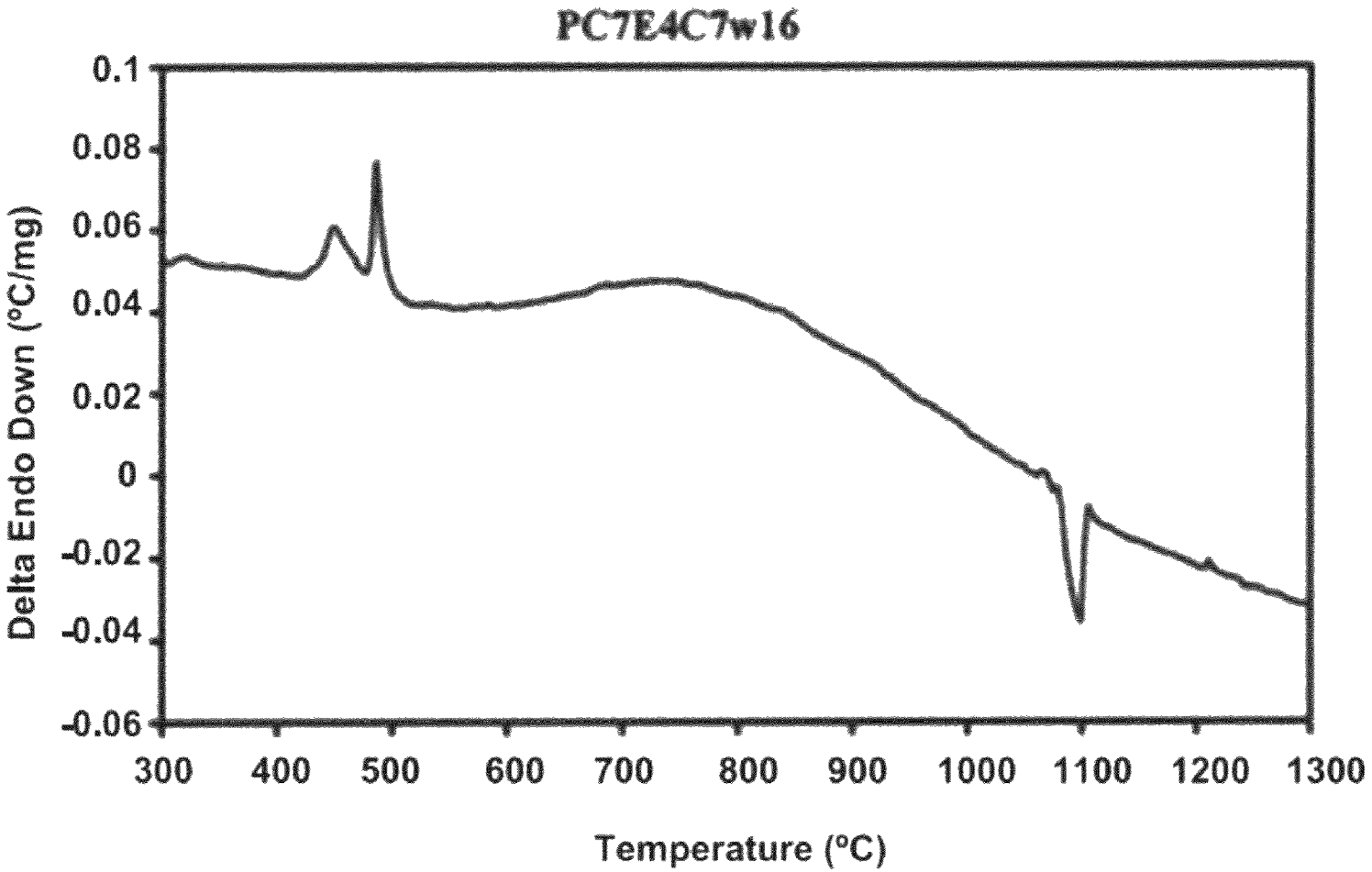
Figure 3A:
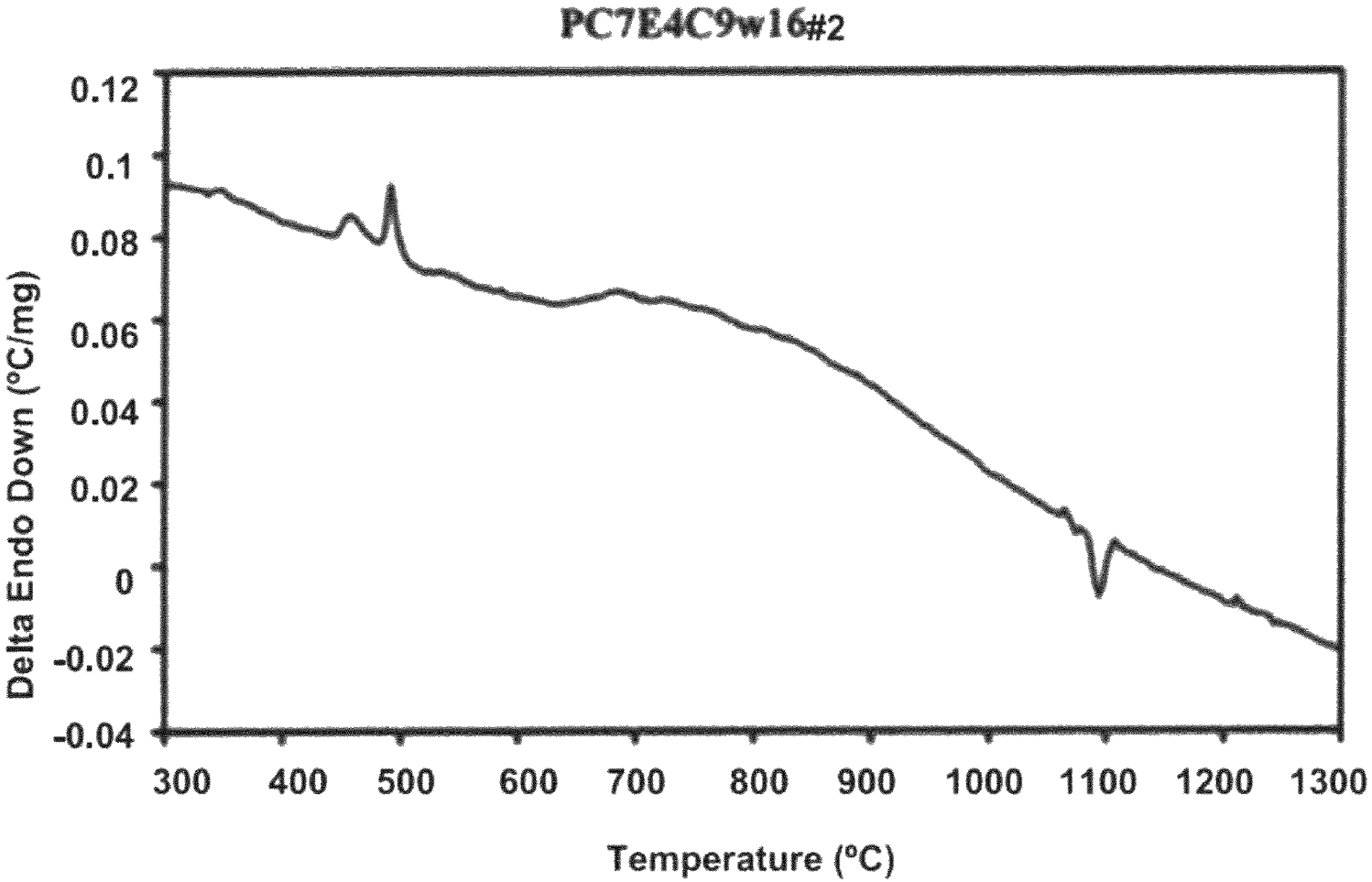
FIGS. 3*a* through 3*f* illustrate DTA curves of the alloys showing the presence of glass to crystalline transformation peak(s) and melting peak(s) (for 16 m/s samples); wherein FIG. 3*a*) illustrates Alloy 13 melt-spun at 16 m/s, FIG. 3*b*) illustrates Alloy 3 melt-spun at 10.5 m/s, FIG. 3*c*) illustrates Alloy 1 melt-spun at 16 m/s, FIG. 3*d*) illustrates Alloy 4 melt-spun at 10.5 m/s, FIG. 3*e*) illustrates ALLOY 2 melt-spun at 10.5 m/s, and FIG. 3*f*) illustrates Alloy 5 melt-spun at 10.5 m/s.
Figure 3B:
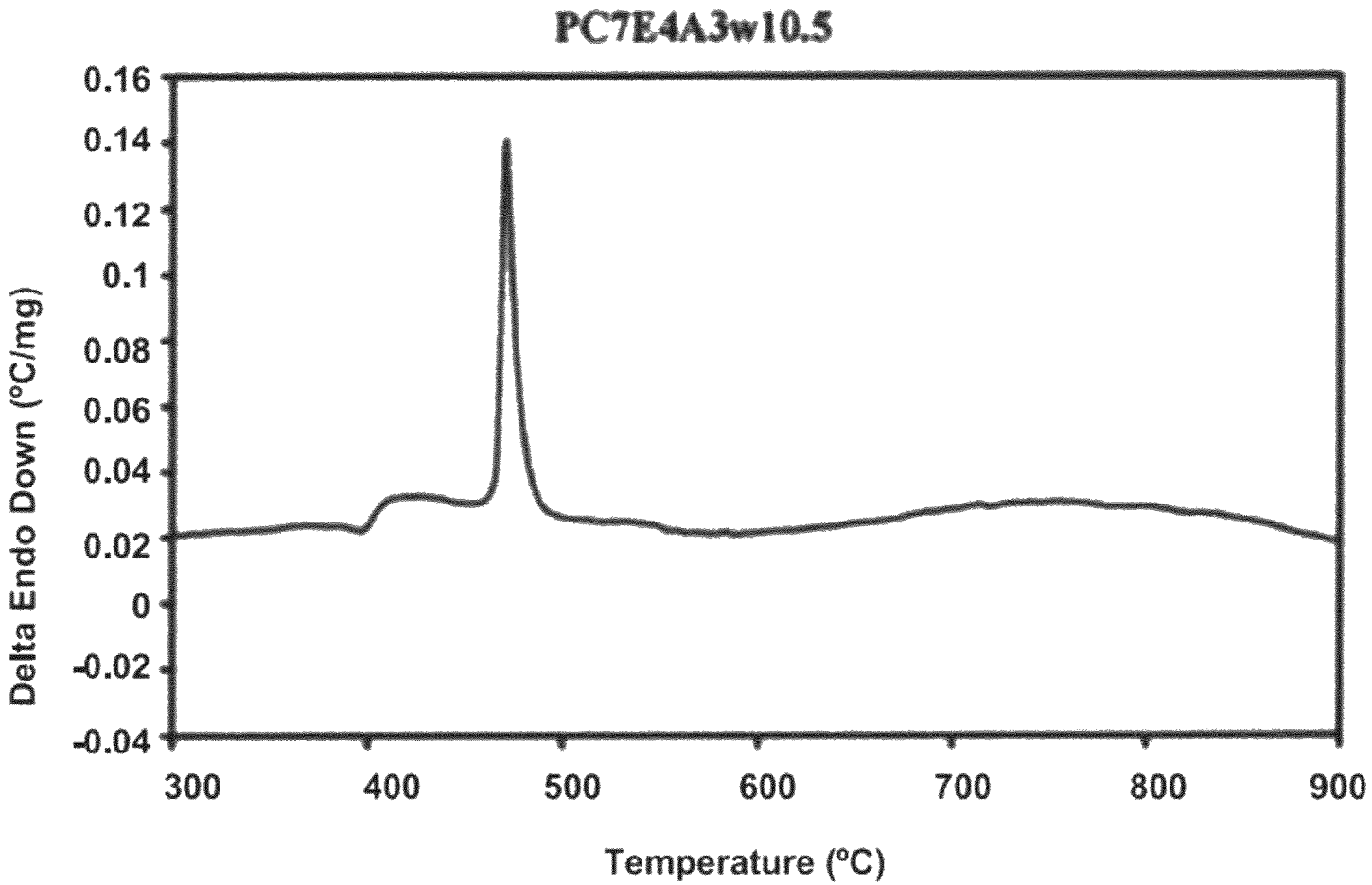
Figure 3C:
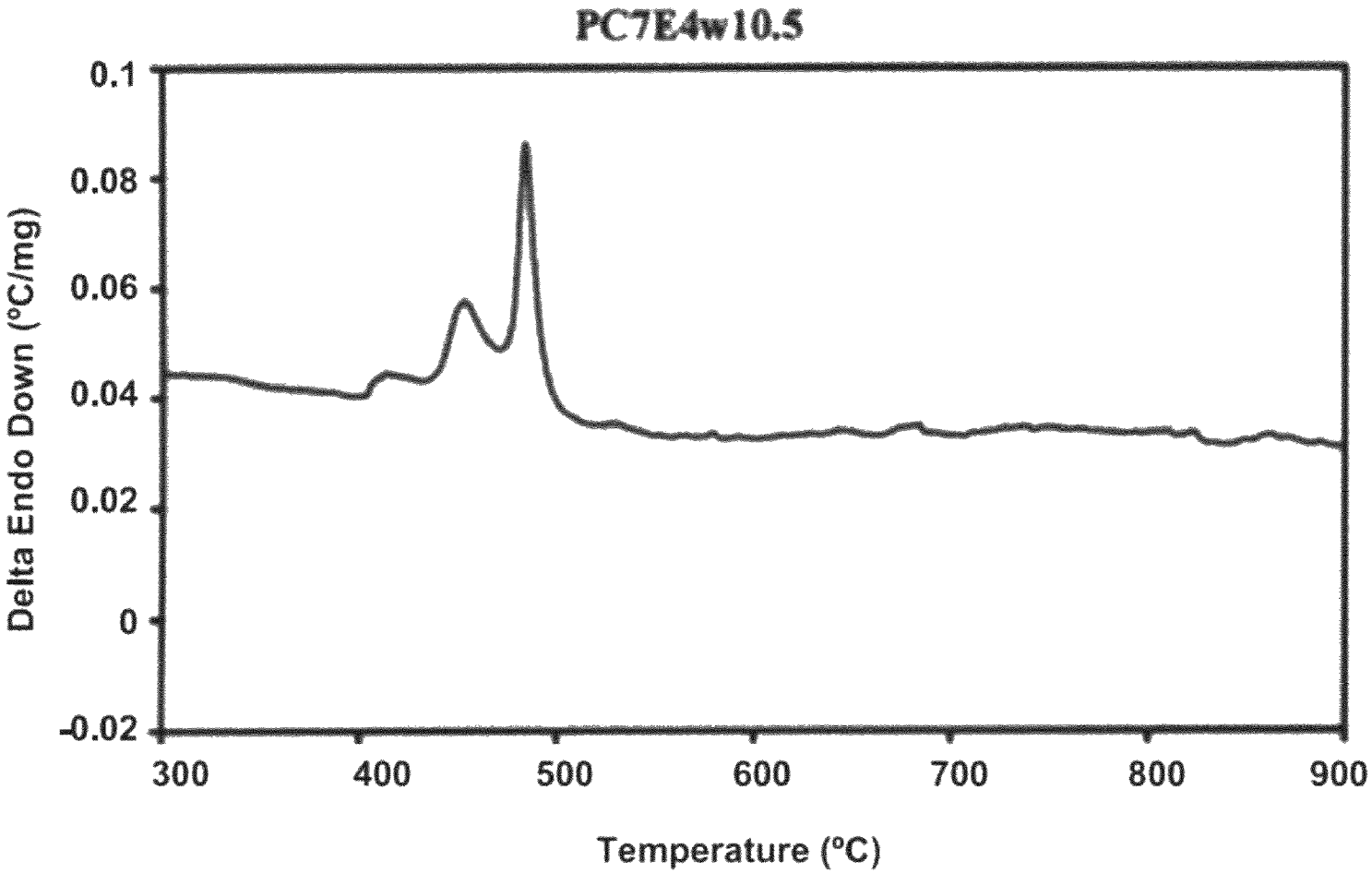
Figure 3D:
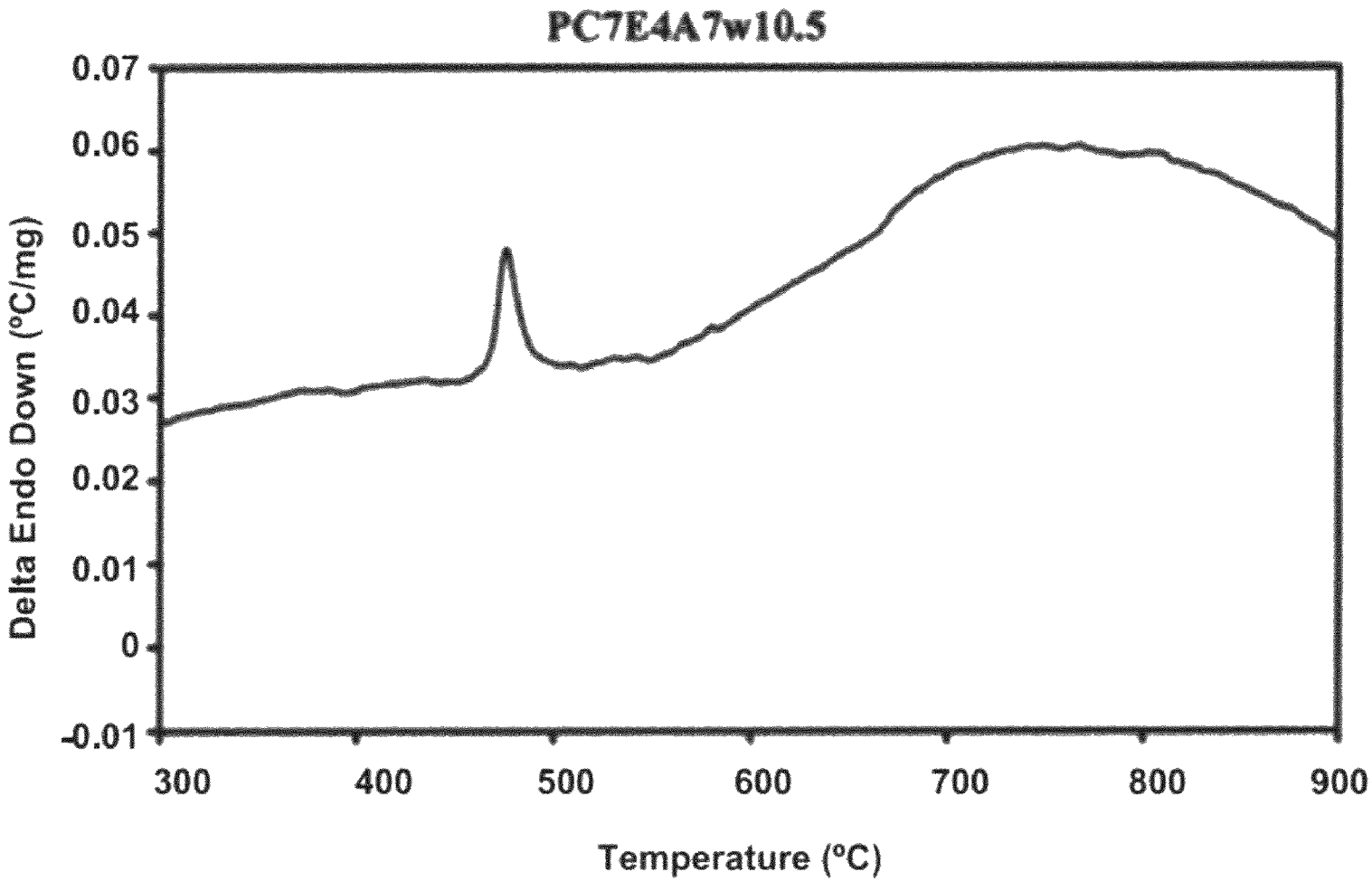
Figure 3E:
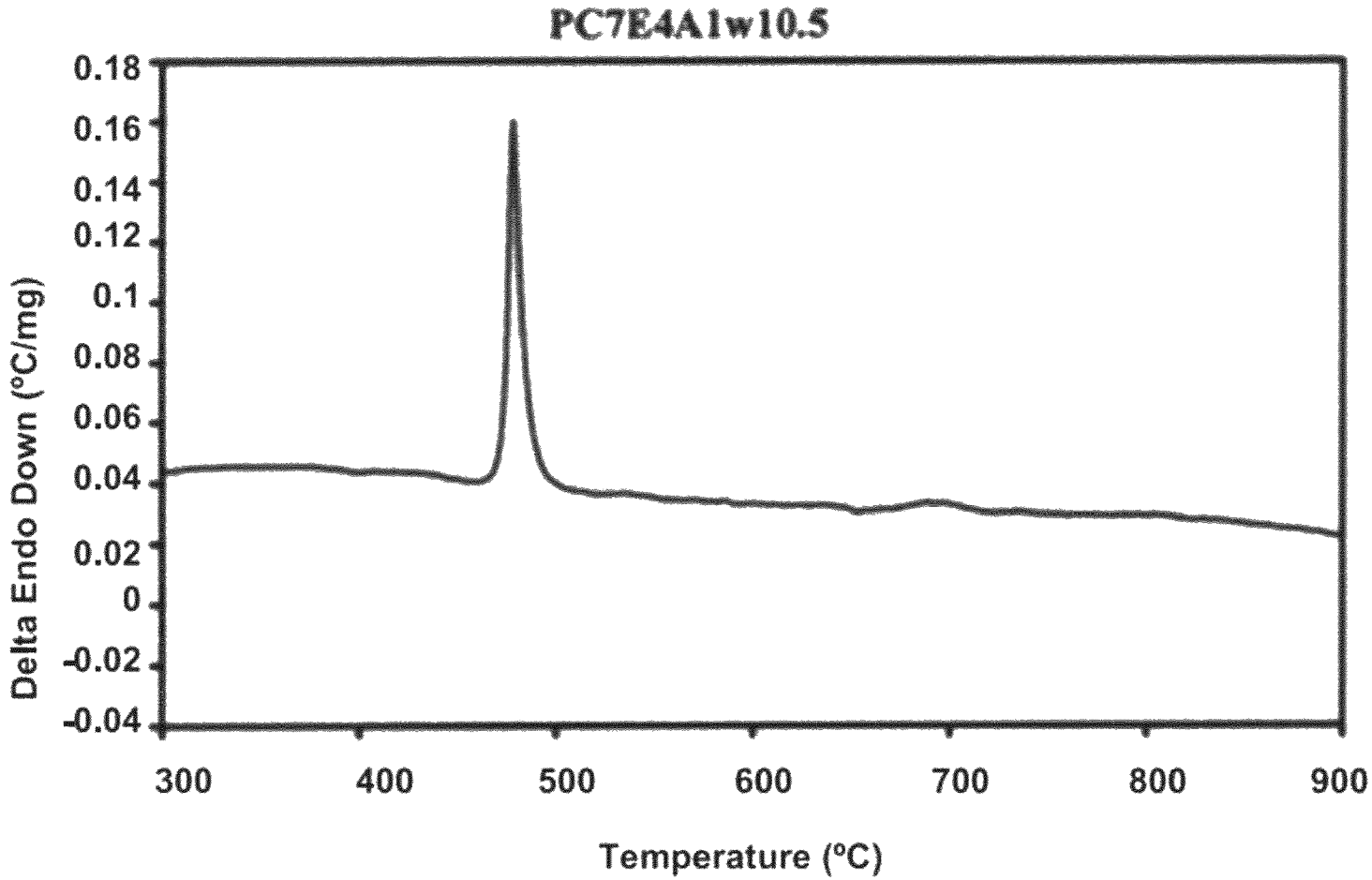
Figure 3F:
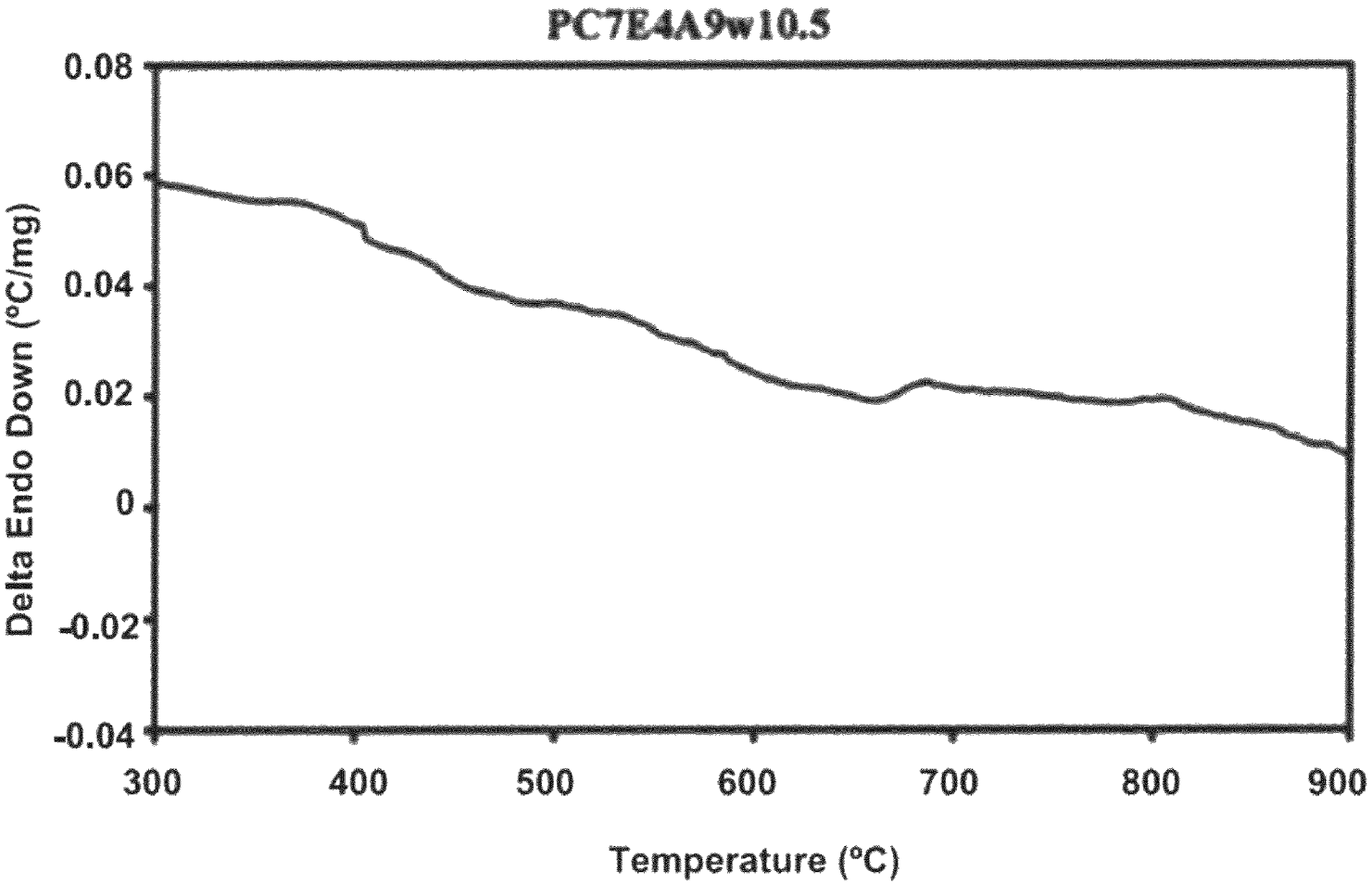
Figure 4A:
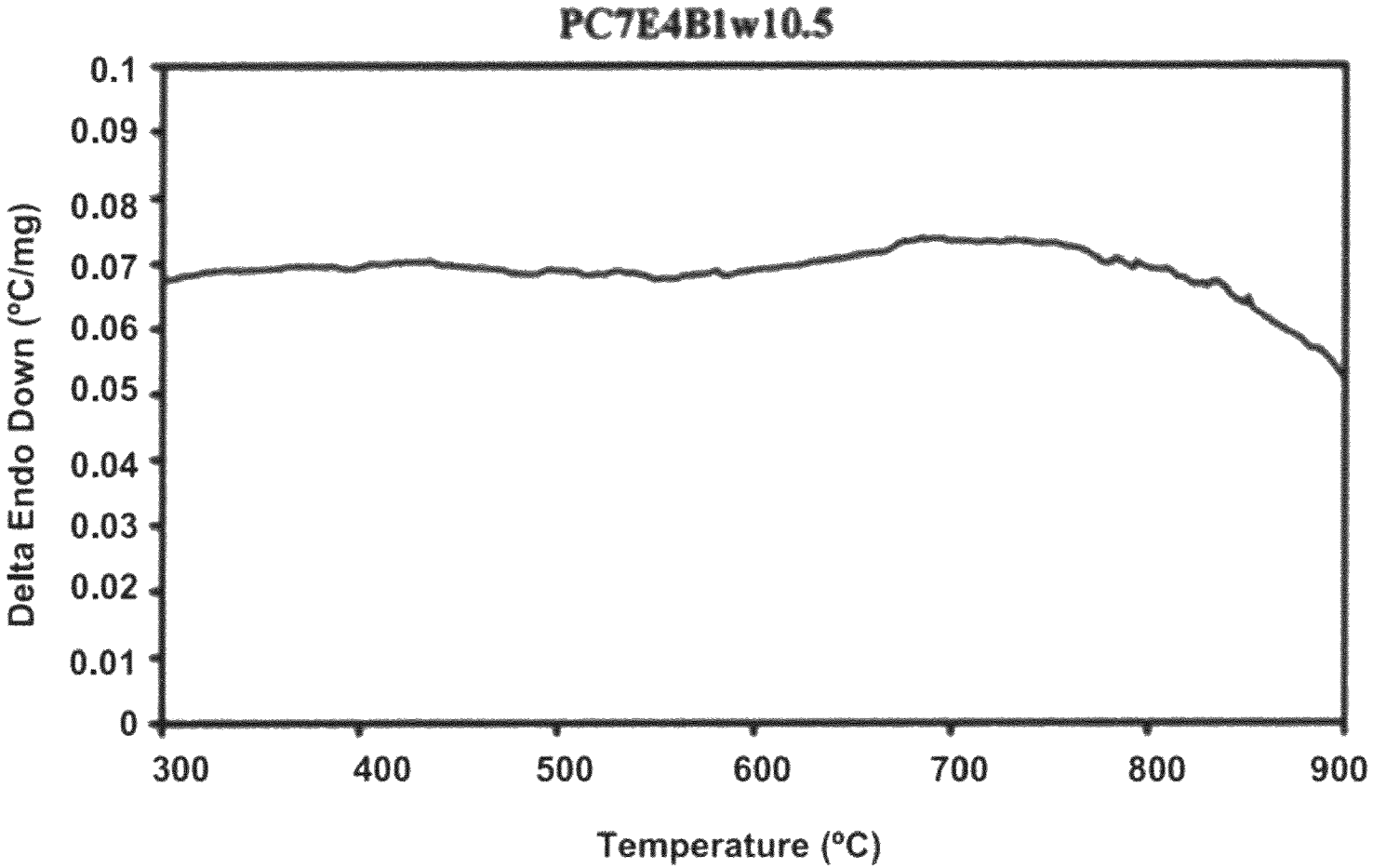
FIGS. 4*a* through 4*f* illustrate DTA curves of the alloys showing the presence of glass to crystalline transformation peak(s); wherein FIG. 4*a*) illustrates Alloy 6 melt-spun at 10.5 m/s, FIG. 4*b*) illustrates Alloy 9 melt-spun at 10.5 m/s, FIG. 4*c*) illustrates Alloy 7 melt-spun at 10.5 m/s, FIG. 4*d*) illustrates Alloy 10 melt-spun at 10.5 m/s, FIG. 4*e*) illustrates ALLOY 8 melt-spun at 10.5 m/s, and FIG. 4*f*) illustrates Alloy 11 melt-spun at 10.5 m/s.
Figure 4B:
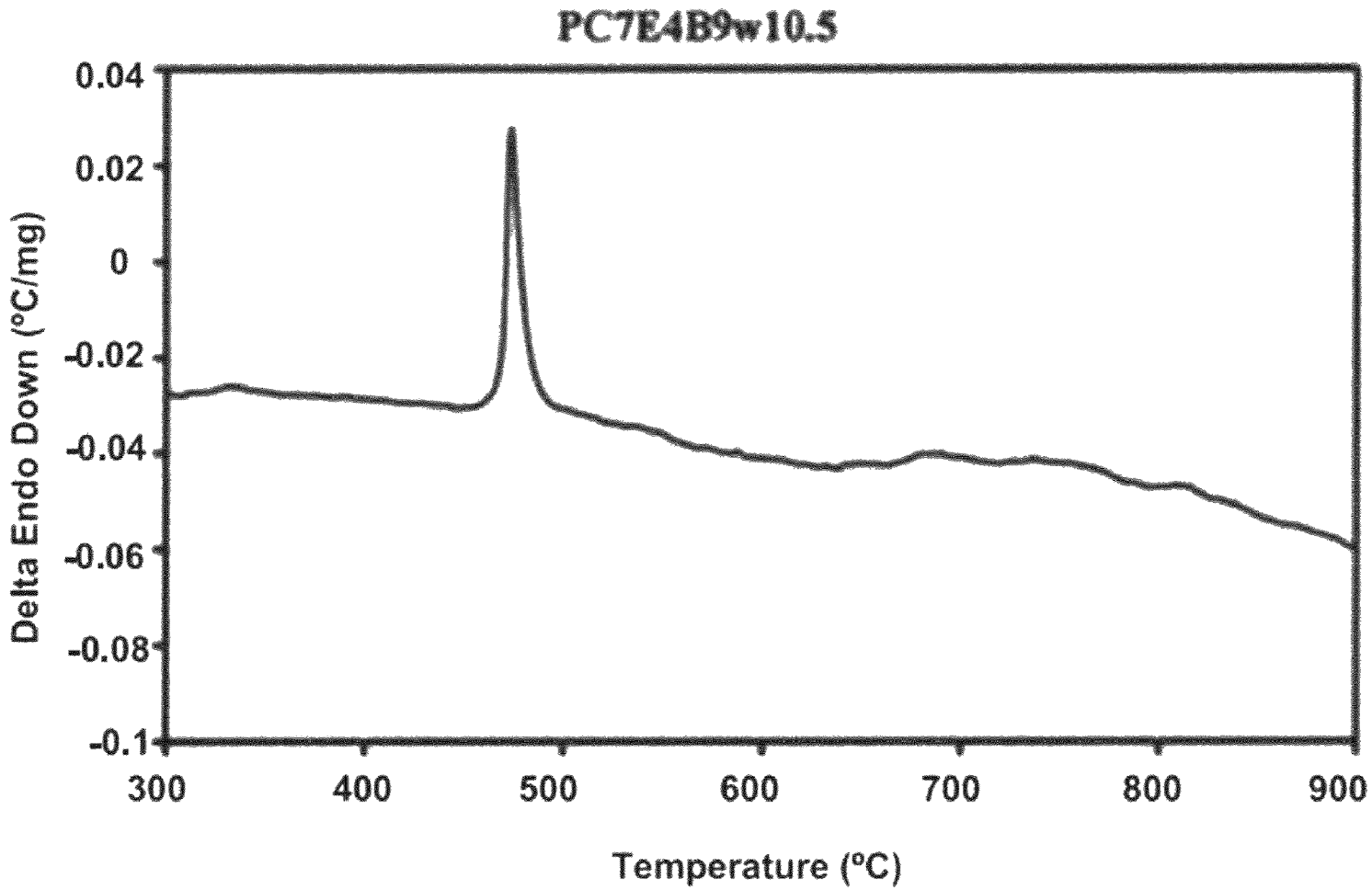
Figure 4C:
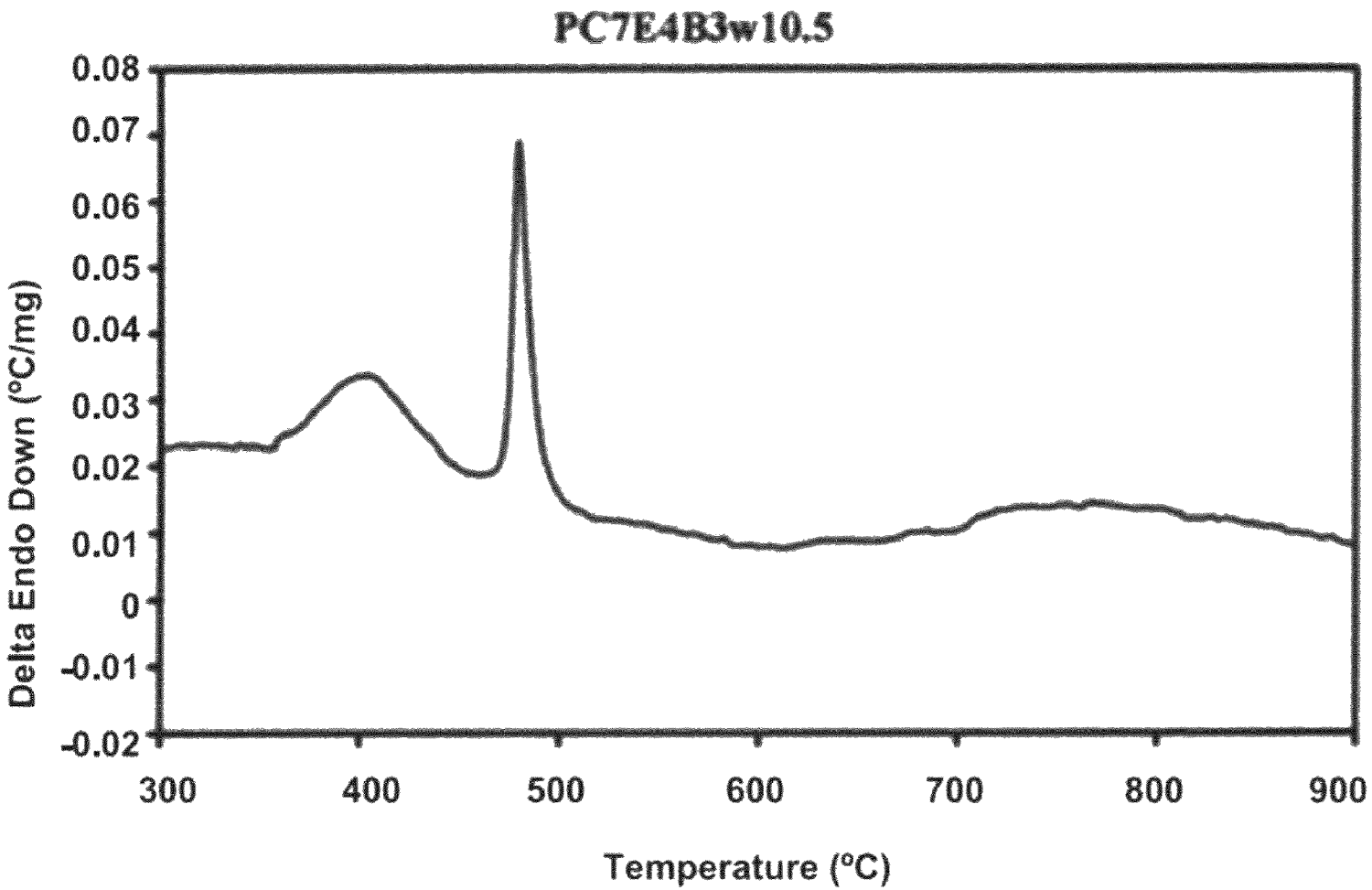
Figure 4D:
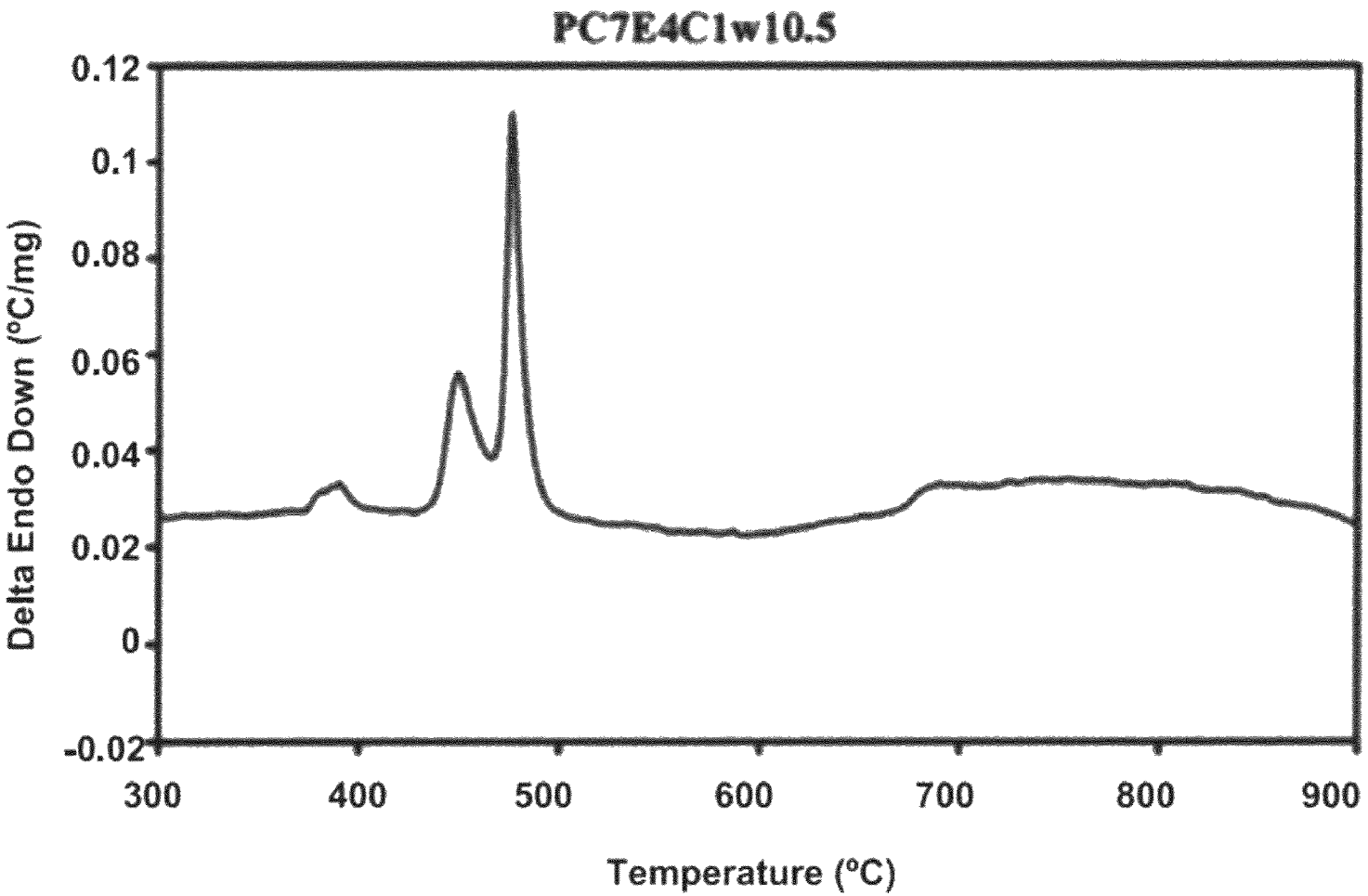
Figure 4E:
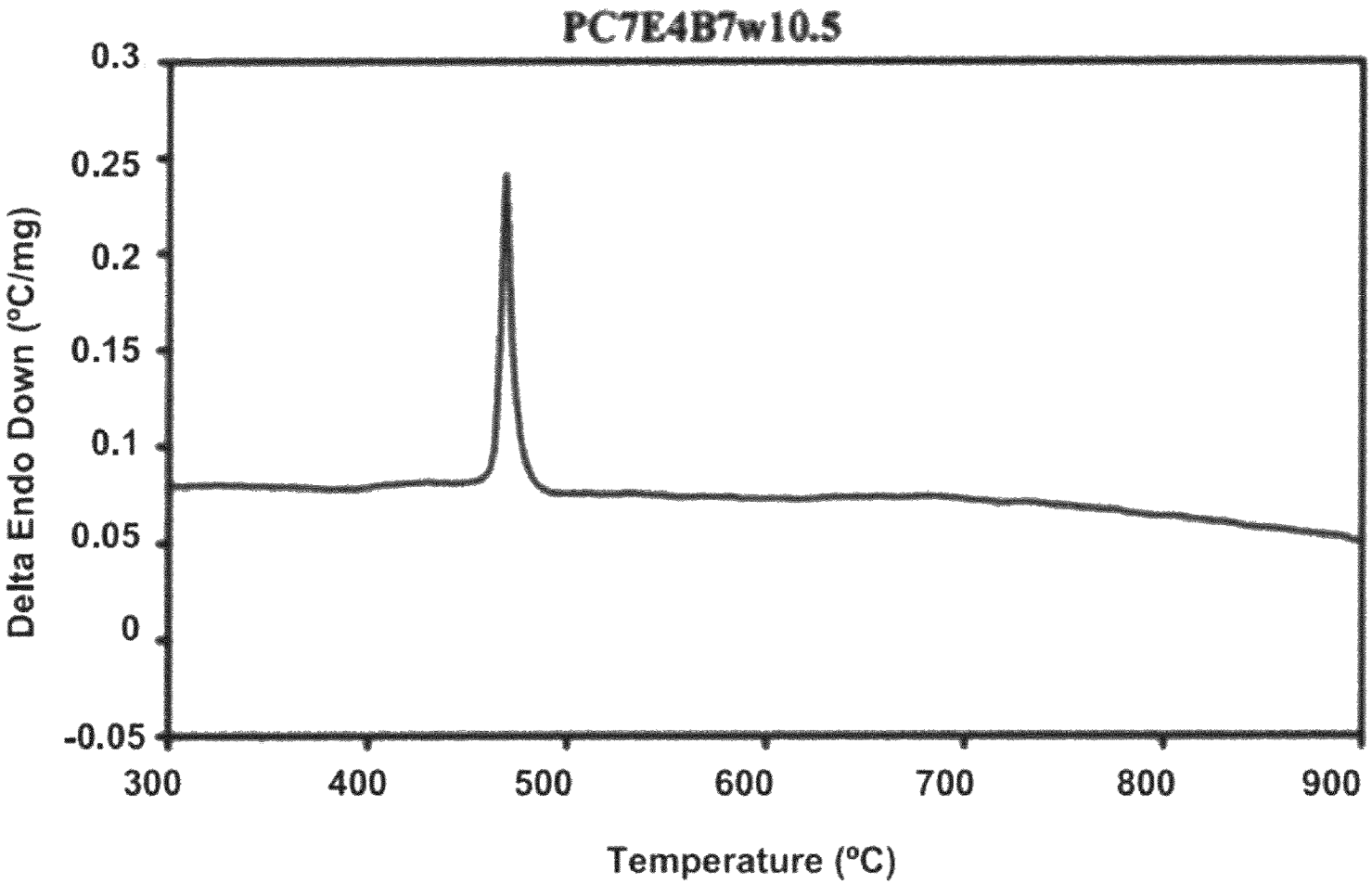
Figure 4F:
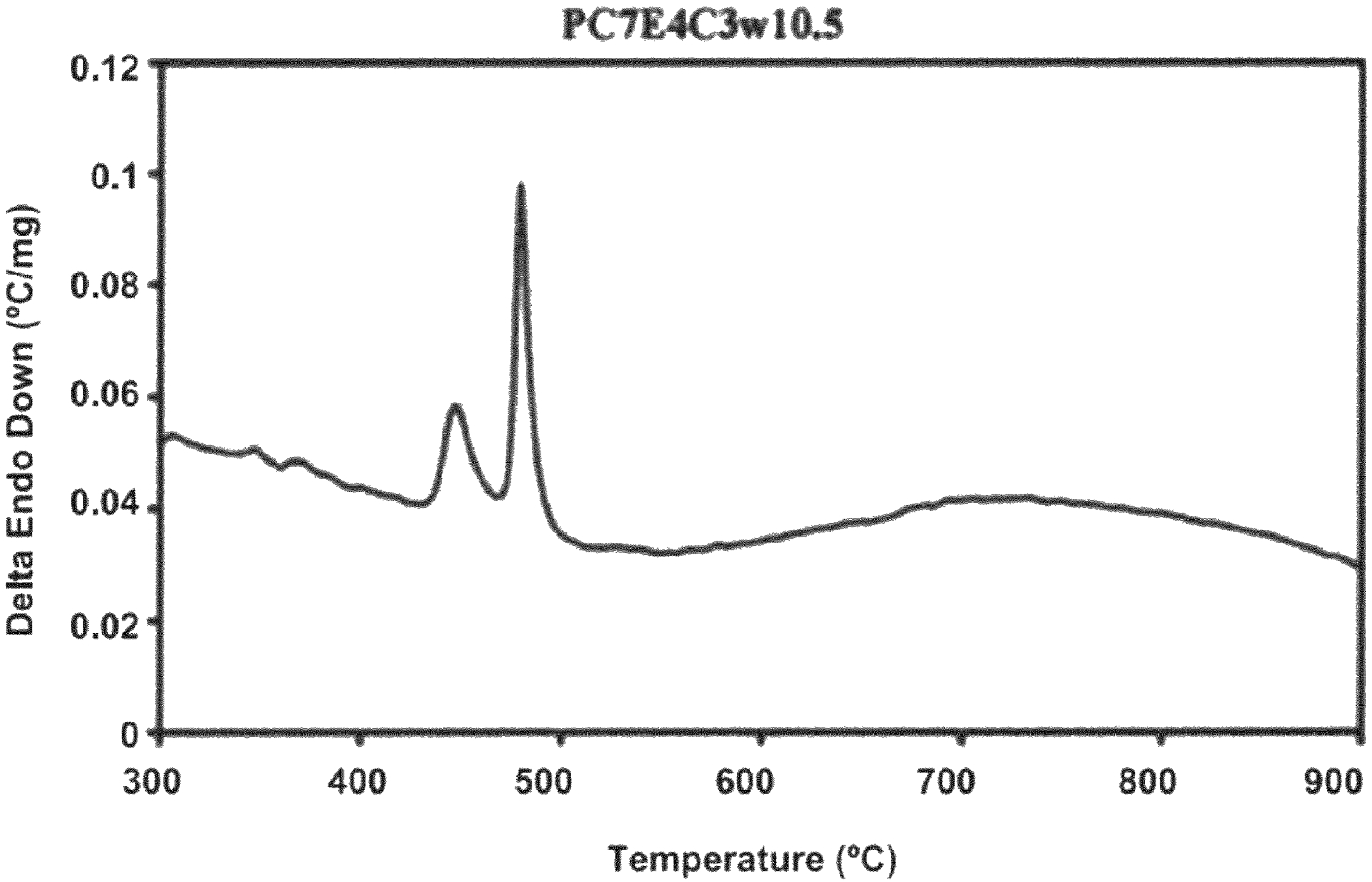
Figure 5A:
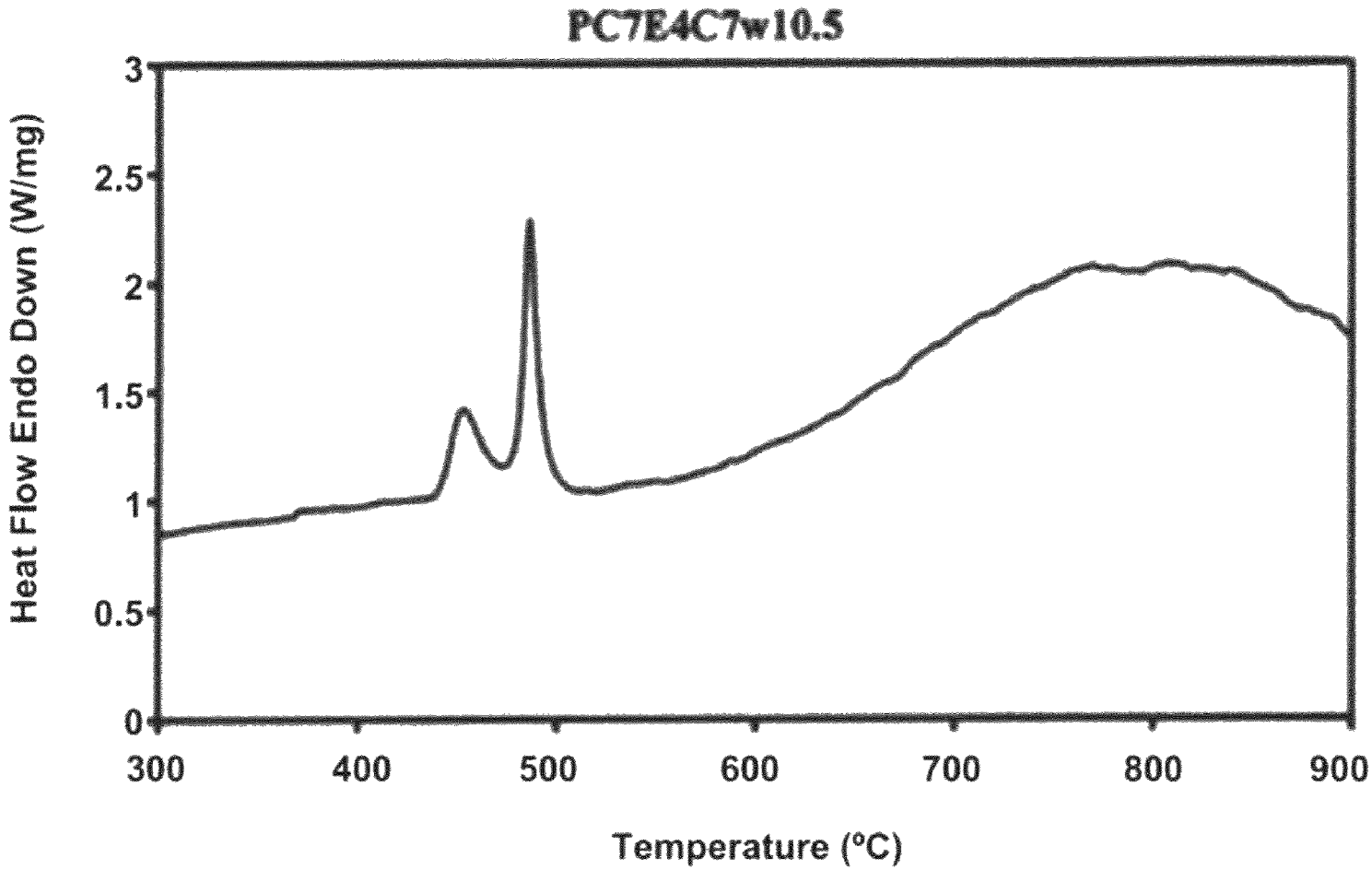
FIGS. 5*a* through 5*b* illustrates DTA curves of the alloys showing the presence of glass to crystalline transformation peak(s)
Figure 5B:
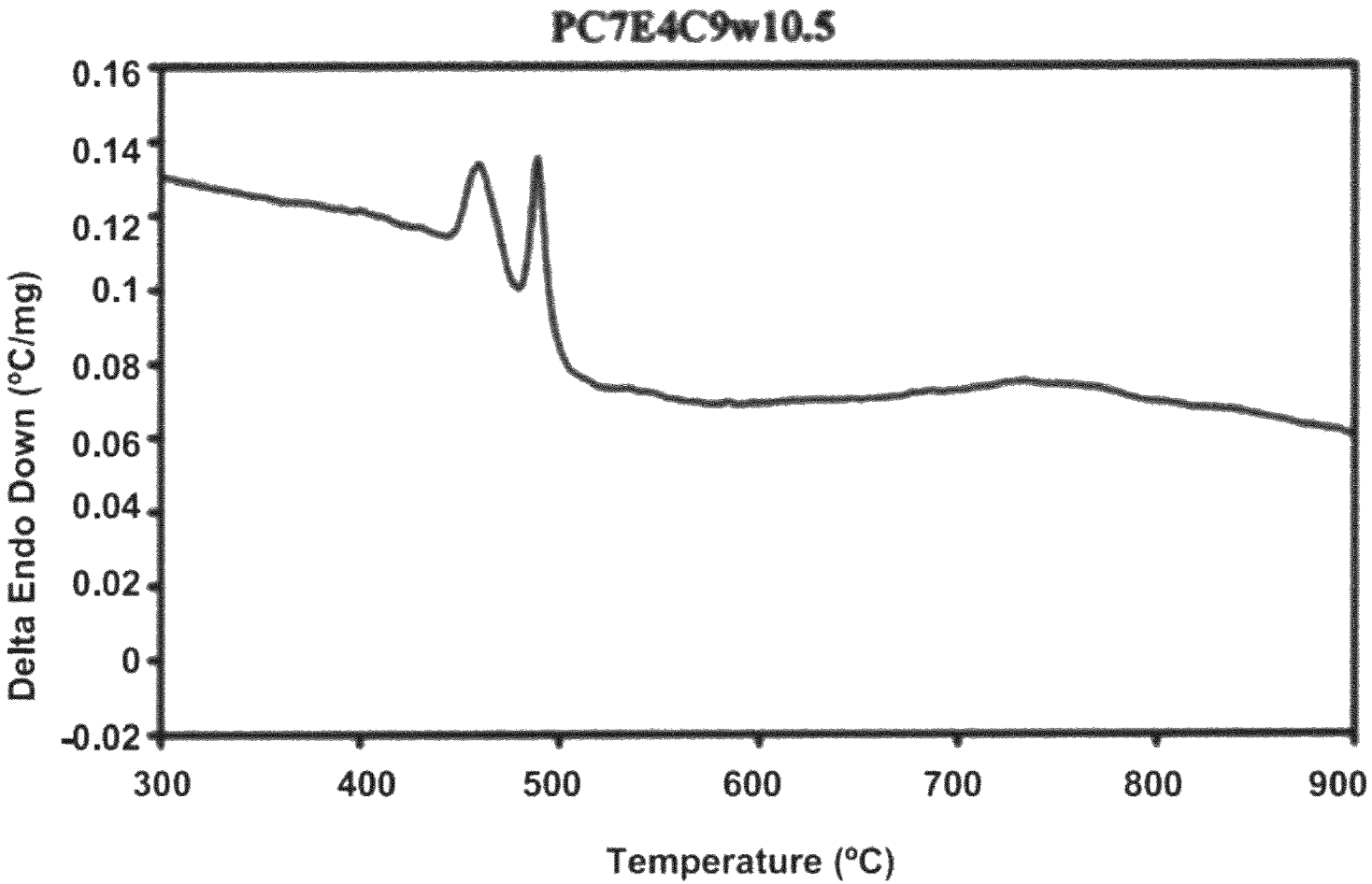

The present application relates to glass forming iron based alloys, which, when formed, may include metallic glass or a mixed structure consisting of metallic glass and nanocrystalline phases. Such alloys may exhibit relatively high strain up to 97% and relatively high strength up to 5.9 GPa. In addition, relatively high elasticity of up to 2.6% has been observed, which may be consistent with the amorphous structure. Thus, the alloys exhibit structures and properties which may yield relatively high elasticity similar to a metallic glass, high plasticity similar to a ductile crystalline metal, and relatively high strength as observed in nanoscale materials.

Metallic glass materials or amorphous metal alloys may exhibit relatively little to no long range order on a scale of a few atoms, such as ordering in the range of 100 nm or less. It may be appreciated that local ordering may be present. Nanocrystalline materials may be understood herein as polycrystalline structures with a mean grain size below 500 nm including all values and increments in the range of 1 nm to 500 nm, such as less than 100 nm. It may be appreciated that to some degree, the characterization of amorphous and nanocrystalline material may overlap and crystal size in a nanocrystalline material may be smaller than the size of short range order in an amorphous composition. These materials are characterized in that they exhibit at least one glass to crystalline transformation measured by differential scanning calorimetry (DSC) at a heating rate of 10° C./min.

The iron based alloys contemplated herein may include at least 35 atomic percent (at %) iron, nickel and/or cobalt in the range of 7 to 50 at %, and at least one non/metal or metalloid selected from the group consisting of boron, carbon, silicon, phosphorus, or nitrogen present in the range of 1 to 35 at %. The atomic percents may then be selected and configured to provide at least 95 atomic percent for a given alloy, the balance to 100 atomic percent being impurities. For example, one may have nickel or cobalt at 7 at % and one of boron, carbon, silicon, phosphorous or nitrogen at 1 at %, the balance iron at 92 at %. In this case there would be no impurities. By way of further example, one may have nickel or cobalt at 7 at % and one of boron, carbon, silicon, phosphorous or nitrogen at 1 at %, the balance iron at 87 at %, the balance being impurities of up to 5 atomic percent.

Therefore, it should be clear that within each of these general ranges of atomic percent for each of the metals one may utilize preferred sub-ranges. For example, in the case of iron, the lower limit of the range may be independently selected from 35, 36, 37, 38, 39, 40, 41, 42, 43, 44, 45, 46, 47, 48, 49, 50, 51, 52, 53, 54 or 55 at %, whereas the upper limit of the range may be independently selected from 92, 91, 90, 89, 88, 87, 86, 85, 84, 83, 82, 81, 80, 79, 78, 77, 76, 75, 74, 73, 72, 71, 70, 69, 68, 67, 66, 65, 64, 63, 62, 61, 60, 59, 58, 57 or 56 at %. Suitable ranges for iron in the alloys according to the present invention may be 45 atomic % to 70 atomic %, or 50 atomic % to 65 atomic % or 52 atomic % to 60 atomic %.

For the second group of ingredients selected from nickel and/or cobalt, the lower limit of the range may be independently selected from 7, 8, 9, 10, 11, 12, 13, 14, 15, 16, 17, 18, 19, 20, 21, 22, 23, 24, 25 or 26 at %, whereas the upper limit of the range may be independently selected from 50, 49, 48, 47, 46, 45, 44, 43, 42, 41, 40, 39, 38, 37, 36, 35, 34, 33, 32, 31, 30, 29, or 28 at %. The alloy of the present invention may contain either nickel or cobalt in amounts within the above specified ranges or a combination of both. For example the alloy of the present invention may contain 10 to 40 at % Ni, whereby the lower limit of the range may be independently selected from 10, 11, 12, 13, 14, 15 or 16 at %, whereas the upper limit of the range may be independently selected from 40, 39, 39, 37, 36, 35, 34, 33, 32, 31, 30, 29, 28, 27, 26, 25, 24, 23, 22, 21, 20, 19 or 18 at %, possibly in combination with cobalt in an amount of 0 to 20, whereby the lower limit of the range may be independently selected from 0, 1, 2, 3, 4, 5, 6, 7, 8, 9 or 10 whereas the upper limit may be independently selected from 20, 19, 18, 17, 16, 15, 14, 13, 12 or 11. Suitable ranges for nickel are 10 to 30 at % or 13 to 18 at %. Suitable ranges for cobalt are 0 to 15 at % or 8 to 12 at %.

For the third group of ingredients the non/metal or metalloid selected from the group consisting of boron, carbon, silicon, phosphorous or nitrogen, the lower limit of the range may be independently selected from 1, 2, 3, 4, 5, 6, 7, 8, 9, 10, 11, 12, 13, 14, 15, 16, 17, 18 at %, whereas the upper limit of the range may be independently selected from 35, 34, 33, 32, 31, 30, 29, 28, 27, 26, 25, 24, 23, 22, 21, 20 or 19 at %.

In some examples, the alloys contemplated herein may include even more preferred sub-ranges of the above mentioned general ranges such as 45 at % to 70 at % iron. A particular preferred sub-range of nickel may be 10 at % to 30 at % nickel. A particular preferred sub-range of cobalt may be 0 at % to 15 at % cobalt. A particularly preferred sub-range of boron may be 7 at % to 25 at % boron. A particular preferred sub-range of carbon may be 0 at % to 6 at %. A particular preferred sub-range of silicon may be 0 at % to 2 at %. It is to be pointed out that according to present invention any of the ranges for a particular component of the alloy of the present invention may be combined with any range of any other component as described herein.

For example, one particularly preferred sub-range for the disclosed alloy may provide alloys having in the range of 52 at % to 60 at % iron, 13 at % to 18 at % nickel, 8 at % to 12 at % cobalt, 10 at % to 17 at % boron, 3 at % to 6 at % carbon, and 0.3 at % to 0.7 at % silicon.

The glass forming iron based alloys may exhibit a general range for the critical cooling rate for metallic glass formation of $10^2$ to $10^6$ K/second (K/s). More preferably, the critical cooling rate may be 100,000 K/s or less, including all values and increments therein such as 10,000 K/s to 1,000 K/s, etc. The resulting structure of the alloy material may consist primarily of metallic glass and/or crystalline nanostructural features less than 500 nm in size. In some examples, the metallic glass and/or nanocrystalline alloy, the alloy may be at least 10% by volume metallic glass, including all values and increments in the range of 10% to 80% by volume metallic glass.

The iron based alloy may exhibit an elastic elongation greater than 0.5%, including all values and increments in the range of 0.5% to 3.0%. Elastic elongation may be understood as, a change in length of a material upon application of a load which may be substantially recoverable. In addition, the iron based alloy may exhibit a tensile or bending elongation greater than 0.6%, such as in the range of 0.6% and up to 97%, including all values and increments therein. Tensile or bending elongation may be understood as an increase in length of sample resulting from the application of a load in tension or bending. Furthermore, the iron based alloy may exhibit strength greater than 1 GPa, including all values and increments in the range of 1 GPa to 5.9 GPa. Strength may be understood as the stress required to break, rupture, or cause failure to the material. It may be appreciated that the alloy may exhibit a combination of properties with a strength greater than 1 GPa and a tensile or bending elongation greater than 2%. The formed iron based alloys may also exhibit a hardness ($VH_{300}$) in the range of 10 GPa to 15 GPa, including all values and increments therein.

The alloys may be prepared by providing feedstock materials at the desired proportions. The feedstock materials may then be melted, such as by arc-melting system or by induction heating, producing a glass forming metal alloy. The glass forming metal alloy may then be formed under a shielding gas, using an inert gas such as argon, into ingots. The formed alloys may be flipped and remelted a number of times to ensure homogeneity of the glass forming metal alloy. The glass forming metal alloy may be further cast or formed into a desired shape. In some examples, the glass forming metal alloys may be melting and then cast on or between one or more copper wheel, forming ribbons or a sheet or film of the alloy composition. In other examples, the glass forming alloy may be fed as a wire or rod into a thermal spray processes, such as HVOF, plasma arc, etc. The final forming process may provide a cooling rate of less than 100,000 K/s.

In some embodiments, the formed alloys may exhibit no grains, phases or crystalline structures, or other long term ordering on the scale of 100 nm or greater, including all values and increments in the range of 100 nm to 1,000 nm. The formed alloy compositions may also exhibit a glass to crystalline transformation onset in the range of 350° C. to 675° C., when measured by DSC at a heating rate of 10° C./min., including all values and increments therein. The formed alloy compositions may exhibit a glass to crystalline transformation peak in the range of 350° C. to 700° C., when measured by DSC at a heating rate of 10° C./min., including all values and increments therein. Furthermore, the formed alloys may exhibit a melting onset in the range of 1000° C. to 1250° C., when measured by DSC at a heating rate of 10° C./min, including all values and increments therein. The formed alloys may also exhibit a melting peak in the range of 1000° C. to 1250° C., including all values and increments therein. It may be appreciated that the alloys may, in some examples, exhibit at least one and possibly up to three glass to crystalline transformations and/or at least one and possibly up to three melting transitions. In addition, the formed alloys may exhibit a density in the range of 7.3 g/cm$^3$ to 7.9 g/cm$^3$.

EXAMPLES

The following examples are presented for the purposes of illustration only and, therefore, are not meant to limit the description provided herein or claims appended hereto.

Sample Preparation

Relatively high purity elements, having a purity of at least 99 at %, were used to prepare 15 g alloy feedstocks of the ALLOY 1 series alloys. The ALLOY 1 series alloy feedstocks were weighed out according to the atomic ratio's provided in Table 1. Each feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities which varied from 5 to 25 m/s. The resulting ALLOY 1 series ribbon that was produced had widths which were typically ~1.25 mm and thickness from 0.02 to 0.15 mm.

TABLE 1

Atomic Ratio's for ALLOY 1 Series Elements

| | Class A | Class B | | Class C | | |
|---|---|---|---|---|---|---|
| | Fe | Ni | Co | B | C | Si |
| ALLOY 1 | 56.00 | 15.50 | 10.00 | 13.20 | 4.80 | 0.50 |
| ALLOY 2 | 56.00 | 13.07 | 8.43 | 16.05 | 5.84 | 0.61 |
| ALLOY 3 | 56.00 | 14.28 | 9.22 | 14.63 | 5.32 | 0.55 |
| ALLOY 4 | 56.00 | 16.72 | 10.78 | 11.77 | 4.28 | 0.45 |
| ALLOY 5 | 56.00 | 17.93 | 11.57 | 10.35 | 3.76 | 0.39 |
| ALLOY 6 | 60.00 | 15.50 | 10.00 | 10.35 | 3.76 | 0.39 |
| ALLOY 7 | 58.00 | 15.50 | 10.00 | 11.77 | 4.28 | 0.45 |
| ALLOY 8 | 54.00 | 15.50 | 10.00 | 14.63 | 5.32 | 0.55 |
| ALLOY 9 | 52.00 | 15.50 | 10.00 | 16.05 | 5.84 | 0.61 |
| ALLOY 10 | 52.00 | 17.93 | 11.57 | 13.20 | 4.80 | 0.50 |
| ALLOY 11 | 54.00 | 16.72 | 10.78 | 13.20 | 4.80 | 0.50 |
| ALLOY 12 | 58.00 | 14.28 | 9.22 | 13.20 | 4.80 | 0.50 |
| ALLOY 13 | 60.00 | 13.07 | 8.43 | 13.20 | 4.80 | 0.50 |

Cooling Rates

Expanding upon the above, it may therefore be appreciated that after melt-spinning, long continuous ribbons are produced which are dimensionally thin in one direction (i.e. the thickness). The thickness of the ribbons that were produced were measured using a micrometer. In Table 1A, the typical ribbon thickness range for the alloys in Table 1 as a function of wheel tangential velocity is shown. Based on the thickness, the cooling rate can be estimated using the well known relation $dT/dt=10/(dc)^2$. In Table 1A, the estimated cooling rate range is shown for each ribbon thickness. As shown, the cooling rate range available in melt-spinning using normal parameters ranges from $2.5*10^6$ to $16*10^3$ K/s. Preferred cooling rates based on the known ductility range is in the range of $10^3$ to $10^6$ K/s.

TABLE 1A

Thickness/Cooling Rate Dependence

| Wheel Speed | Ribbon Thickness | Cooling Rate K/s | |
|---|---|---|---|
| (m/s) | (μm) | Thin | Thick |
| 39 | 20-25 | 2,500,000 | 1,600,000 |
| 30 | 30-40 | 1,111,111 | 625,000 |
| 16 | 60-70 | 277,778 | 204,082 |
| 10.5 | 70-80 | 204,082 | 156,250 |
| 7.5 | 120-140 | 69,444 | 51,020 |
| 5 | 180-250 | 30,864 | 16,000 |

It should also be noted that the cooling rate dependency to obtain a glass-like or nanocrystalline morphology may depend on the precise composition of a given alloy and may therefore be determined for a given alloy composition. For example, this may be accomplished by measuring the glass-crystalline transition by DSC as noted herein.

Density

The density of the alloys in ingot form was measured using the Archimedes method in a balance allowing for weighing in both air and distilled water. The density of the arc-melted 15 gram ingots for each alloy is tabulated in Table 2 and was found to vary from 7.39 g/cm$^3$ to 7.85 g/cm$^3$. Experimental results have revealed that the accuracy of this technique is +−0.01 g/cm$^3$.

TABLE 2

Density of Alloys

| Alloy | Density (g/cm$^3$) |
|---|---|
| ALLOY 1 | 7.75 |
| ALLOY 2 | 7.39 |
| ALLOY 3 | 7.70 |
| ALLOY 4 | 7.82 |
| ALLOY 5 | 7.85 |
| ALLOY 6 | 7.83 |
| ALLOY 7 | 7.81 |
| ALLOY 8 | 7.72 |
| ALLOY 9 | 7.69 |
| ALLOY 10 | 7.79 |
| ALLOY 11 | 7.77 |
| ALLOY 12 | 7.74 |
| ALLOY 13 | 7.73 |

As-Solidified Structure

Thermal analysis was performed on the as-solidified ribbon structure on a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 3, the DSC data related to the glass to crystalline transformation is shown for the ALLOY 1 series alloys that have been melt-spun at two different wheel tangential velocities at 16 m/s and 10.5 m/s. Note that the cooling rate increases at increasing wheel tangential velocities. Typical ribbon thickness's for the alloys melt-spun at 16 m/s and 10.5 m/s are 0.04 to 0.05 mm and 0.06 to 0.08 mm respectively. In FIG. 1 through 5, the corresponding DTA plots are shown for each ALLOY 1 series sample melt-spun at 16 and 10.5 m/s. As can be seen, the majority of samples (all but two) exhibit glass to crystalline transformations verifying that the as-spun state contains significant fractions of metallic glass. The glass to crystalline transformation occurs in either one stage, two stage, or three stages in the range of temperature from ~350 to ~700° C. and with enthalpies of transformation from ~−1 to ~−125 J/g.

TABLE 3

DSC Data for Glass To Crystalline Transformations

| Alloy | Glass | Peak #1 Onset (° C.) | Peak #1 Peak (° C.) | ΔH (−J/g) | Peak #2 Onset (° C.) | Peak #2 Peak (° C.) | ΔH (−J/g) | Peak #3 Onset (° C.) | Peak #3 Peak (° C.) | ΔH (−J/g) |
|---|---|---|---|---|---|---|---|---|---|---|
| ALLOY 1w16 | Yes | 430 | 442 | 35.9 | 478 | 483 | 58.1 | | | |
| ALLOY 1w10.5 | Yes | 440 | 453 | 34.1 | 477 | 484 | 56.2 | | | |
| ALLOY 2w16 | Yes | 474 | 477 | 66.2 | | | | | | |
| ALLOY 2w10.5 | Yes | 473 | 478 | 100.7 | | | | | | |
| ALLOY 3w16 | Yes | 464 | 469 | 71.7 | | | | | | |

TABLE 3-continued

DSC Data for Glass To Crystalline Transformations

| Alloy | Glass | Peak #1 Onset (° C.) | Peak #1 Peak (° C.) | ΔH (−J/g) | Peak #2 Onset (° C.) | Peak #2 Peak (° C.) | ΔH (−J/g) | Peak #3 Onset (° C.) | Peak #3 Peak (° C.) | ΔH (−J/g) |
|---|---|---|---|---|---|---|---|---|---|---|
| ALLOY 3w10.5 | Yes | 466 | 471 | 90.5 | | | | | | |
| ALLOY 4w16 | Yes | 390 | 411 | 5.8 | 471 | 477 | 13.3 | | | |
| ALLOY 4w10.5 | Yes | 468 | 476 | 17.8 | | | | | | |
| ALLOY 5w16 | Yes | 465 | 473 | 3.4 | | | | | | |
| ALLOY 5w10.5 | No | | | | | | | | | |
| ALLOY 6w16 | Yes | 473 | 478 | 22.8 | | | | | | |
| ALLOY 6w10.5 | No | | | | | | | | | |
| ALLOY 7w16 | Yes | 411 | 426 | * | 431 | 435 | 19.9 | 478 | 483 | 21.7 |
| ALLOY 7w10.5 | Yes | 358 | 405 | 64.6 | 474 | 480 | 60.1 | | | |
| ALLOY 8w16 | Yes | 437 | 450 | 22.8 | 477 | 483 | 44.4 | 665 | 683 | 3.3 |
| ALLOY 8w10.5 | Yes | 463 | 469 | 119.0 | | | | | | |
| ALLOY 9w16 | Yes | 428 | 439 | 1.5 | 471 | 474 | 35.7 | 669 | 678 | 4.9 |
| ALLOY 9w10.5 | Yes | 469 | 474 | 49.0 | | | | | | |
| ALLOY 10w16 | Yes | 460 | 468 | 121.8 | 477 | 483 | * | | | |
| ALLOY 10w10.5 | Yes | 374 | 390 | 5.8 | 437 | 450 | 46.6 | 471 | 476 | ~76.5 |
| ALLOY 11w16 | Yes | 439 | 449 | 13.0 | 475 | 480 | 24.6 | | | |
| ALLOY 11w10.5 | Yes | 437 | 447 | 30.6 | 475 | 480 | 53.8 | | | |
| ALLOY 12w16 | Yes | 432 | 450 | 34.2 | 481 | 486 | 35.4 | | | |
| ALLOY 12w10.5 | Yes | 442 | 453 | 43.1 | 481 | 486 | 70.4 | | | |
| ALLOY 13w16 | Yes | 444 | 457 | 12.4 | 484 | 491 | 17.7 | | | |
| ALLOY 13w10.5 | Yes | 447 | 460 | 50.2 | 482 | 489 | 46.5 | | | |

* Overlapping peaks, peak 1 and peak 2 enthalpy combined

In Table 4, elevated temperature DTA results are shown indicating the melting behavior for the ALLOY 1 series alloys. As can be seen in Table 4 and FIGS. 1 through 3, the melting occurs in 1 to 3 stages with initial melting (i.e. solidus) observed from ~1060° C. to ~1100° C. with final melting up to ~1130° C.

TABLE 4

Differential Thermal Analysis Data for Melting Behavior

| Alloy | Peak #1 Onset (° C.) | Peak #1 Peak (° C.) | Peak #2 Onset (° C.) | Peak #2 Peak (° C.) | Peak #3 Onset (° C.) | Peak #3 Peak (° C.) |
|---|---|---|---|---|---|---|
| ALLOY 1w16 | 1078 | 1088 | 1089 | 1095 | | |
| ALLOY 2w16 | 1071 | 1085 | 1115 | 1129 | | |
| ALLOY 3w16 | 1077 | 1087 | 1089 | 1096 | | |
| ALLOY 4w16 | 1099 | 1087 | 1086 | 1091 | | |
| ALLOY 5w16 | 1079 | 1090 | 1084 | 1092 | 1080 | 1095 |
| ALLOY 6w16 | 1085 | 1094 | 1094 | 1102 | | |
| ALLOY 7w16 | 1083 | 1090 | 1093 | 1098 | | |
| ALLOY 8w16 | 1075 | 1087 | 1082 | 1092 | 1087 | 1098 |
| ALLOY 9w16 | 1064 | 1074 | 1070 | 1076 | 1108 | 1119 |
| ALLOY 10w16 | 1078 | 1095 | 1089 | 1100 | | |
| ALLOY 11w16 | 1075 | 1083 | 1080 | 1088 | 1086 | 1094 |
| ALLOY 11w5 | 1076 | 1090 | 1088 | 1098 | | |
| ALLOY 12w16 | 1081 | 1098 | | | | |
| ALLOY 13w16 | 1085 | 1093 | | | | |

SEM Microscopy Studies

To further examine the ribbon structure, scanning electron microscopy (SEM) was done on selected ribbon samples. Melt spun ribbons were mounted in a standard metallographic mount with several ribbons held using a metallography binder clip. The binder clip containing the ribbons was set into a mold and an epoxy is poured in and allowed to harden. The resulting metallographic mount was ground and polished using appropriate media following standard metallographic practices. The structure of the samples was observed using an EVO-60 scanning electron microscope manufactured by Carl Zeiss SMT Inc. Typical operating conditions were electron beam energy of 17.5 kV, filament current of 2.4 A, and spot size setting of 800. Energy Dispersive Spectroscopy was conducted with an Apollo silicon drift detector (SDD-10) using Genesis software both of which are from EDAX. The amplifier time was set to 6.4 micro-sec so that the detector dead time was about 12-15%.

Figure 6:
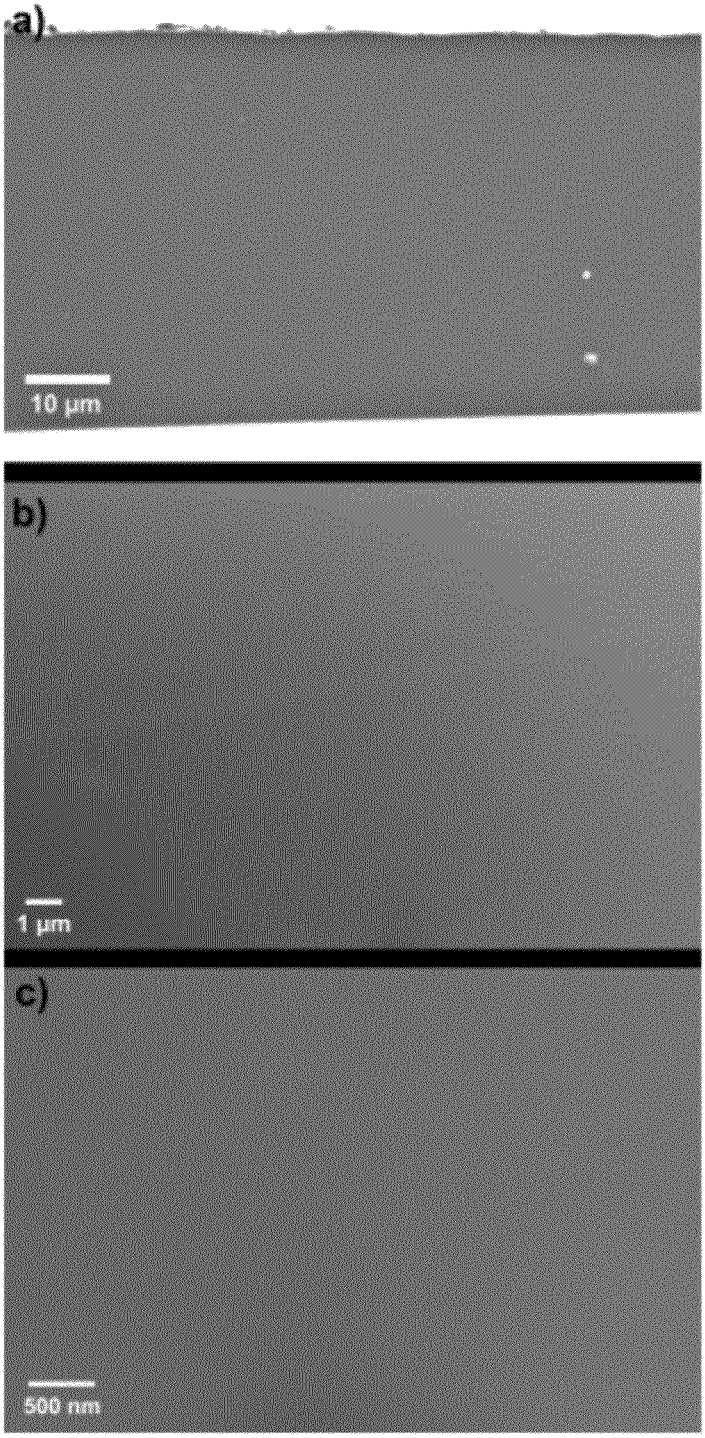
FIGS. 6*a* through 6*c* illustrate SEM backscattered electron micrograph of the ALLOY 1 ribbon melt-spun at 16 m/s; wherein FIG. 6*a*) illustrates low magnification showing the entire ribbon cross section, note the presence of isolated points of porosity, FIG. 6*b*) illustrates medium magnification of the ribbon structure, and FIG. 6*c*) illustrates high magnification of the ribbon structure.
Figure 7:
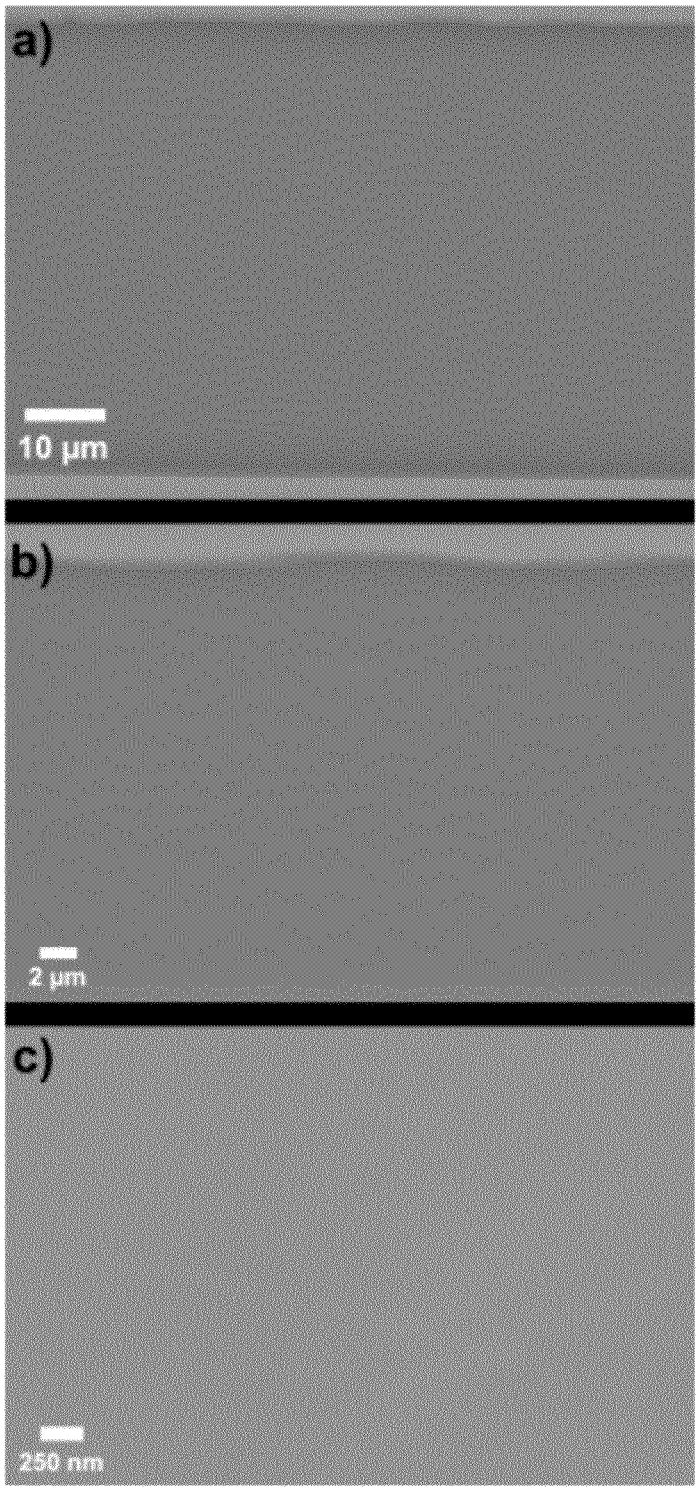
FIGS. 7*a* through 7*c* illustrate SEM backscattered electron micrograph of the ALLOY 7 ribbon melt-spun at 16 m/s; wherein FIG. 7*a*) illustrates low magnification showing the entire ribbon cross section, FIG. 7*b*) illustrates medium magnification of the ribbon structure, note the presence of the free surface at the top of the ribbon, and FIG. 7*c*) illustrates high magnification of the ribbon structure.
Figure 8:
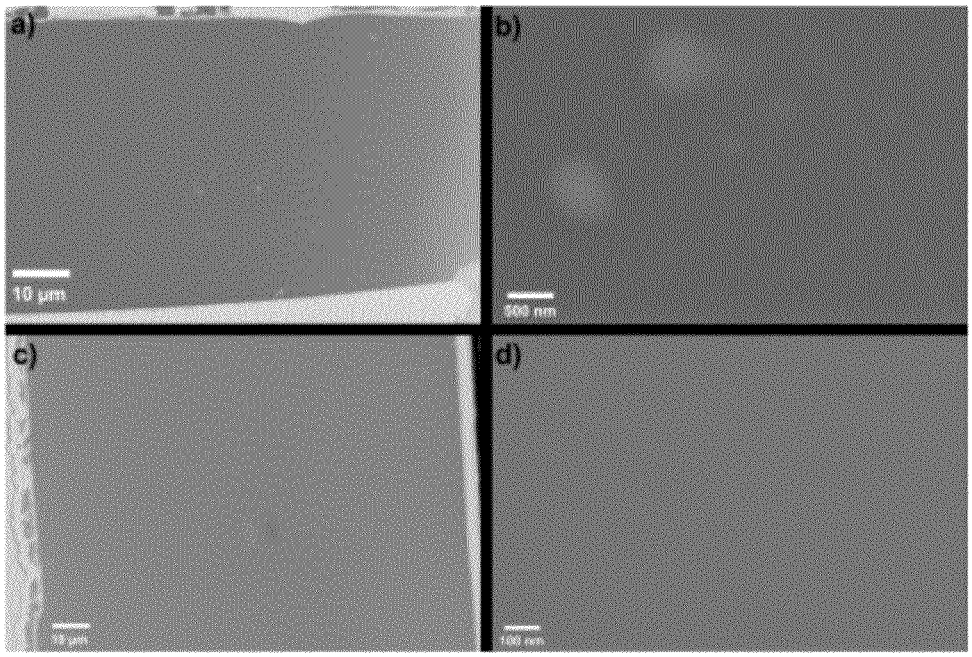
FIGS. 8*a* through 8d illustrate SEM backscattered electron micrograph of the ALLOY 11 ribbon; wherein FIG. 8*a*) illustrates low magnification showing the entire ribbon cross section at 16 m/s, FIG. 8*b*) illustrates high magnification of the ribbon structure at 16 m/s, note the presence of scratches and voids, FIG. 8*c*) illustrates low magnification showing the entire ribbon cross section at 10.5 m/s, note the presence of a Vickers hardness indentation, and FIG. 8*d*) illustrates high magnification of the ribbon structure at 10 m/s.
Figure 9:
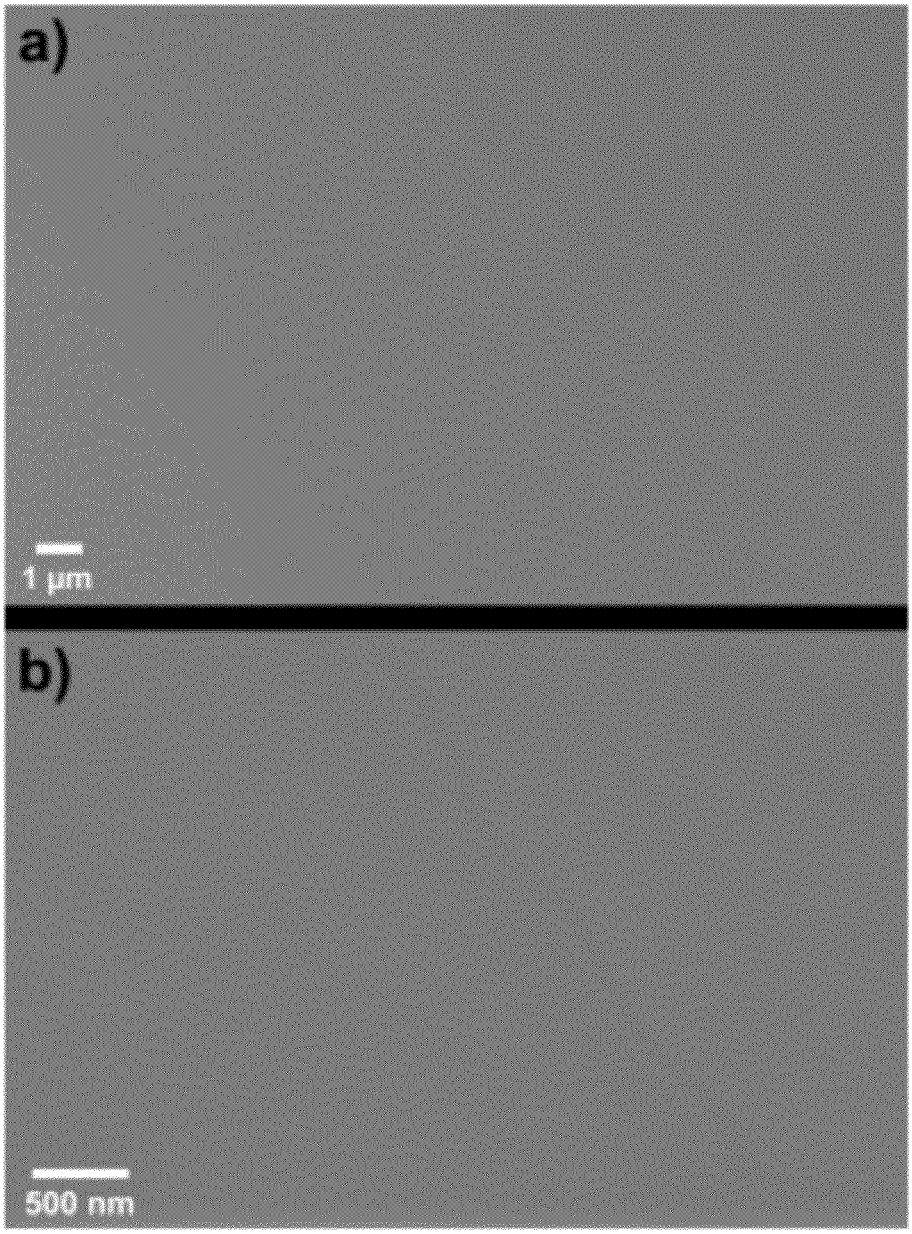
FIGS. 9*a* through 9*b* illustrate SEM backscattered electron micrograph of the ALLOY 11 ribbon melt-spun at 16 m/s and then annealed at 1000° C. for 1 hour; wherein FIG. 9*a*) illustrates medium magnification of the ribbon structure, and FIG. 9*b*) illustrates high magnification of the ribbon structure.

In FIG. 6, SEM backscattered electron micrograph are shown of the ALLOY 1 ribbon melt-spun at 16 m/s. As can be seen, while isolated points of porosity are found, no crystalline structural features were observed. In FIG. 7, SEM backscattered electron micrographs of the ALLOY 7 ribbons melt-spun at 16 m/s are shown. Consistent with the ALLOY 1 results low, medium, and high magnification images do not reveal any grains, phases, or crystalline structure. In FIG. 8, SEM backscattered electron micrograph of the ALLOY 11 ribbon are shown comparing the 16 m/s sample to the 10.5 m/s samples. Note that no crystalline structure is found on the scale of the resolution limit of the SEM and no differences between the two cooling rates were observed. In FIG. 9, SEM backscattered electron micrograph of the ALLOY 11 ribbon melt-spun at 16 m/s and then annealed at 1000° C. for 1 hour are shown at two different magnifications. Note that even after this very high temperature heat treatment, no grains, phases, or crystalline material was found.

Figure 10:
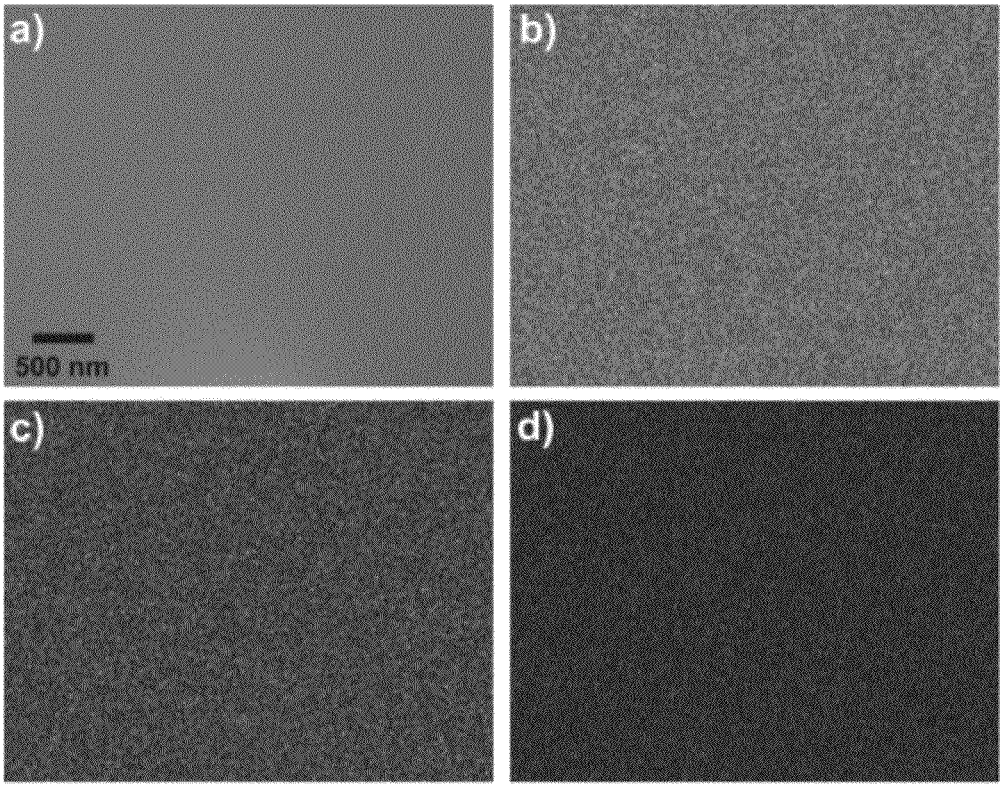
FIGS. 10*a* through 10*d* illustrate SEM secondary electron micrograph and EDS scans of the ALLOY 11 ribbon melt-spun at 16 m/s; wherein FIG. 10*a*) illustrates high magnification secondary electron picture of the ribbon structure, FIG. 10*b*) illustrates EDS map showing the presence of iron, FIG. 10*c*) illustrates EDS map showing the presence of nickel, and FIG. 10*d*) illustrates EDS map showing the presence of cobalt.
Figure 11:
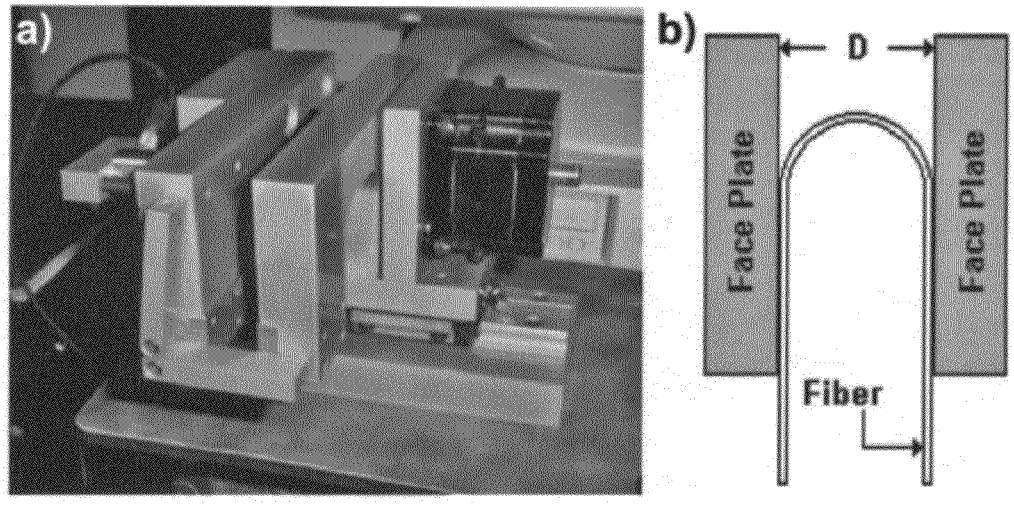
FIGS. 11*a* and 11*b* illustrate the two point bend test system; wherein FIG. 11*a*) is a picture of bend tester, and FIG. 11*b*) illustrates a close-up schematic of bending process.

From the DTA results, it is relatively clear that a heat treatment at this temperature would certainly lead to full devitrification so the results indicate that the grains/phases that are formed are very stable against coarsening. In FIG. 10*a*, a high magnification secondary electron micrograph is shown of the ALLOY 11 ribbon melt-spun at 16 m/s. Energy dispersive spectroscopy (EDS) maps were taken at low (1,770×), medium (5,000×), and high magnification (20,000×). In FIGS. 10*b*, 10*c*, and 10*d*; high magnification EDS maps of iron, nickel, and cobalt respectively are shown corresponding to the region shown in FIG. 10*a*. As can be seen, a uniform distribution of iron, nickel, and cobalt are found consistent with the lack of phases found. Note that the speckled morphology of the pictures is not due to chemical segregation but is an artifact of the EDS scanning resolution.

Mechanical Property Testing

Mechanical property testing was performed primarily through using nanoindentor testing to measure Young's modulus and bend testing to measure breaking strength and elongation. The following sections detail the technical approach and measured data.

Nano-Indentation Testing

Nano-indentation uses an established method where an indenter tip with a known geometry is driven into a specific site of the material to be tested, by applying an increasing normal load. After reaching a pre-set maximum value, the normal load is reduced until partial or complete relaxation occurs. This procedure is performed repetitively; at each stage of the experiment and the position of the indenter relative to the sample surface is precisely monitored with a differential capacitive sensor. For each loading/unloading cycle, the applied load value is plotted with respect to the corresponding position of the indenter. The resulting load/displacement curves provide data specific to the mechanical nature of the material under examination. Calculation of the Young's Modulus is done by first calculating the reduced modulus (see Equation #1), $E_r$ and then using that value to calculate Young's Modulus (see Equation #2).

$$E_r = \frac{\sqrt{\pi}}{2}\frac{S}{\sqrt{A_c}} = \frac{\sqrt{\pi}}{2}\frac{1}{C}\frac{1}{\sqrt{A_c}} \qquad \text{Equation \#1}$$

which can be calculated having derived S and $A_C$ from the indentation curve using the area function, $A_C$ being the projected contact area.

$$\frac{1}{E_r} = \frac{1-v^2}{E} + \frac{1-v_i^2}{E_i} \qquad \text{Equation \#2}$$

where $E_i$ and $v_i$ are the Young's modulus and Poisson coefficient of the indenter and v the Poisson coefficient of the tested sample.

The test conditions shown in Table 5 were used for the nano-indentation measurements. The measured values of Hardness and Young's modulus for the samples as well as the penetration depth (Δd) are tabulated in Tables 6 through 10 with their averages and standard deviations. As shown, the hardness was found to be very high and ranged from 960 to 1410 kg/mm$^2$ (10.3 to 14.9 GPa). The elastic modulus (i.e. Young's Modulus) was found to vary from 119 to 134 GPa. Since all ALLOY 1 series alloys were not measured using nanoindentation, the Young's modulus was estimated for the remaining alloys to be within the existing range and 125 GPa was used for bend testing calculations of strength.

TABLE 5

Parameters Used For Nanoindentation

| | |
|---|---|
| Maximum force (mN) | 300 |
| Maximum depth (nm) | N/A |
| Loading rate (mN/min) | 600 |
| Unloading rate (mN/min) | 600 |
| Pause (s) | 0 |
| Computation Method | Oliver & Pharr |
| Indenter type | Berkovich |

TABLE 6

Nanoindentation Test Results for ALLOY 11 Ribbon at 16 m/s

| | Hv [Vickers] | H [GPa] | E [GPa] | Δd [μm] |
|---|---|---|---|---|
| 1 | 1108.49 | 11.73 | 133.61 | 1.34 |
| 2 | 969.52 | 10.26 | 117.63 | 1.43 |
| 3 | 1061.97 | 11.24 | 126.80 | 1.37 |
| 4 | 1026.85 | 10.87 | 123.27 | 1.39 |
| 5 | 1012.81 | 10.72 | 123.04 | 1.40 |
| Average | 1035.93 | 10.96 | 124.87 | 1.39 |
| Std dev | 46.84 | 0.50 | 5.26 | 0.03 |

TABLE 7

Nanoindentation Test Results for ALLOY 1 Ribbon at 16 m/s

| | Hv [Vickers] | H [GPa] | E [GPa] | Δd [μm] |
|---|---|---|---|---|
| 1 | 1083.37 | 11.46 | 127.75 | 1.36 |
| 2 | 1082.66 | 11.46 | 127.13 | 1.36 |
| 3 | 1084.57 | 11.48 | 128.43 | 1.36 |
| 4 | 1103.14 | 11.67 | 129.74 | 1.35 |
| 5 | 1081.20 | 11.44 | 131.45 | 1.36 |
| Average | 1087.11 | 11.50 | 128.90 | 1.36 |
| Std dev | 8.10 | 0.08 | 1.54 | 0.004 |

TABLE 8

Nanoindentation Test Results for ALLOY 7 Ribbon at 16 m/s

| | Hv [Vickers] | H [GPa] | E [GPa] | Δd [μm] |
|---|---|---|---|---|
| 1 | 1261.18 | 13.35 | 129.14 | 1.31 |
| 2 | 1409.36 | 14.91 | 141.64 | 1.25 |
| 3 | 1398.76 | 14.80 | 133.46 | 1.27 |
| 4 | 1322.84 | 14.00 | 138.57 | 1.27 |
| 5 | 1203.07 | 12.73 | 127.86 | 1.33 |
| Average | 1319.04 | 13.96 | 134.13 | 1.29 |
| Std dev | 79.15 | 0.84 | 5.31 | 0.029 |

TABLE 9

Nanoindentation Test Results for ALLOY 3 Ribbon at 16 m/s

| | Hv [Vickers] | H [GPa] | E [GPa] | Δd [μm] |
|---|---|---|---|---|
| 1 | 1035.74 | 10.96 | 118.44 | 1.40 |
| 2 | 1047.94 | 11.09 | 118.20 | 1.40 |
| 3 | 1047.08 | 11.08 | 117.97 | 1.40 |
| 4 | 1048.99 | 11.10 | 118.29 | 1.40 |

TABLE 9-continued

| Nanoindentation Test Results for ALLOY 3 Ribbon at 16 m/s | | | | |
|---|---|---|---|---|
| | Hv [Vickers] | H [GPa] | E [GPa] | Δd [μm] |
| 5 | 1074.18 | 11.37 | 120.58 | 1.38 |
| Average | 1050.79 | 11.12 | 118.70 | 1.40 |
| Std dev | 12.64 | 0.13 | 0.95 | 0.01 |

TABLE 10

| Nanoindentation Test Results for ALLOY 11 Ribbon at 5 m/s | | | | |
|---|---|---|---|---|
| | Hv [Vickers] | H [GPa] | E [GPa] | Δd [μm] |
| 1 | 968.91 | 10.25 | 129.87 | 1.40 |
| 2 | 975.18 | 10.32 | 130.02 | 1.40 |
| 3 | 958.18 | 10.14 | 128.19 | 1.41 |
| 4 | 1028.37 | 10.88 | 137.00 | 1.36 |
| 5 | 1098.01 | 11.62 | 140.01 | 1.33 |
| Average | 1005.73 | 10.64 | 133.02 | 1.38 |
| Std dev | 52.11 | 0.55 | 4.62 | 0.03 |

Two-Point Bend Testing

The two-point bending method for strength measurement was developed for thin, highly flexible specimens, such as optical fibers and ribbons. The method involves bending a length of tape (fiber, ribbon, etc.) into a "U" shape and inserting it between two flat and parallel faceplates. One faceplate is stationary while the second is moved by a computer controlled stepper motor so that the gap between the faceplates may be controlled to a precision of better than ~5 μm with an ~10 μm systematic uncertainty due to the zero separation position of the faceplates (FIG. 1). The stepper motor moves the faceplates together at a precisely controlled specified speed at any speed up to 10,000 μm/s. Fracture of the tape is detected using an acoustic sensor which stops the stepper motor. Since for measurements on the tapes, the faceplate separation at failure varied between 2 and 11 mm, the precision of the equipment does not influence the results.

The strength of the specimens may be calculated from the faceplate separation at failure. The faceplates constrain the tape to a particular deformation so that the measurement directly gives the strain to failure. The Young's modulus of the material is used to calculate the failure stress according to the following formulas (Equation #3):

$$\varepsilon_f = 1.198\left(\frac{d}{D-d}\right)$$

$$\sigma_f = 1.198E\left(\frac{d}{D-d}\right)$$

where d is the tape thickness and D is the faceplate separation at failure. Young's modulus was measured from nanoindentation testing and was found to vary from 119 to 134 GPa for the ALLOY 1 series alloys. As indicated earlier, for the samples not measured Young's Modulus was estimated to be 125 GPa. The shape of the tape between the faceplates is an elastica which is similar to an ellipse with an aspect ratio of ~2:1. The equation assumes elastic deformation of the tape. When tapes shatter on failure and the broken ends do not show any permanent deformation, there is not extensive plastic deformation at the failure site and so the equations are accurate. Note that even if plastic deformation occurs as shown in a number of the ALLOY 1 series alloys, the bending measurements would still provide a relative measure of strength. The strength data for materials is typically fitted to a Weibull distribution as shown in Equation #4:

$$P_f = 1 - \exp\left\{-\left(\frac{\varepsilon}{\varepsilon_0}\right)^m\right\}$$

where m is the Weibull modulus (an inverse measure of distribution width) and $\epsilon_0$ is the Weibull scale parameter (a measure of centrality, actually the 63% failure probability). In general, m is a dimensionless number corresponding to the variability in measured strength and reflects the distribution of flaws. This distribution is widely used because it is simple to incorporate Weibull's weakest link theory which describes how the strength of specimens depends on their size.

Figure 12:
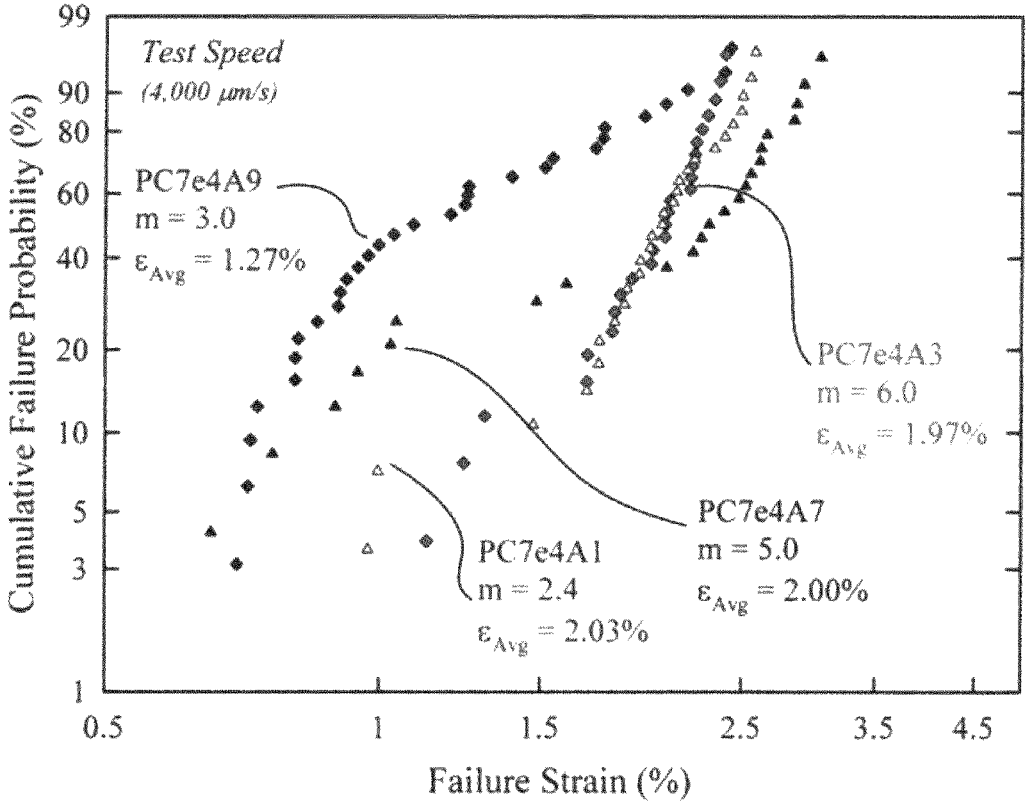
FIG. 12 illustrates bend test data showing the cumulative failure probability as a function of failure strain for the ALLOY 1A series alloys melt-spun at 16 m/s.
Figure 13:
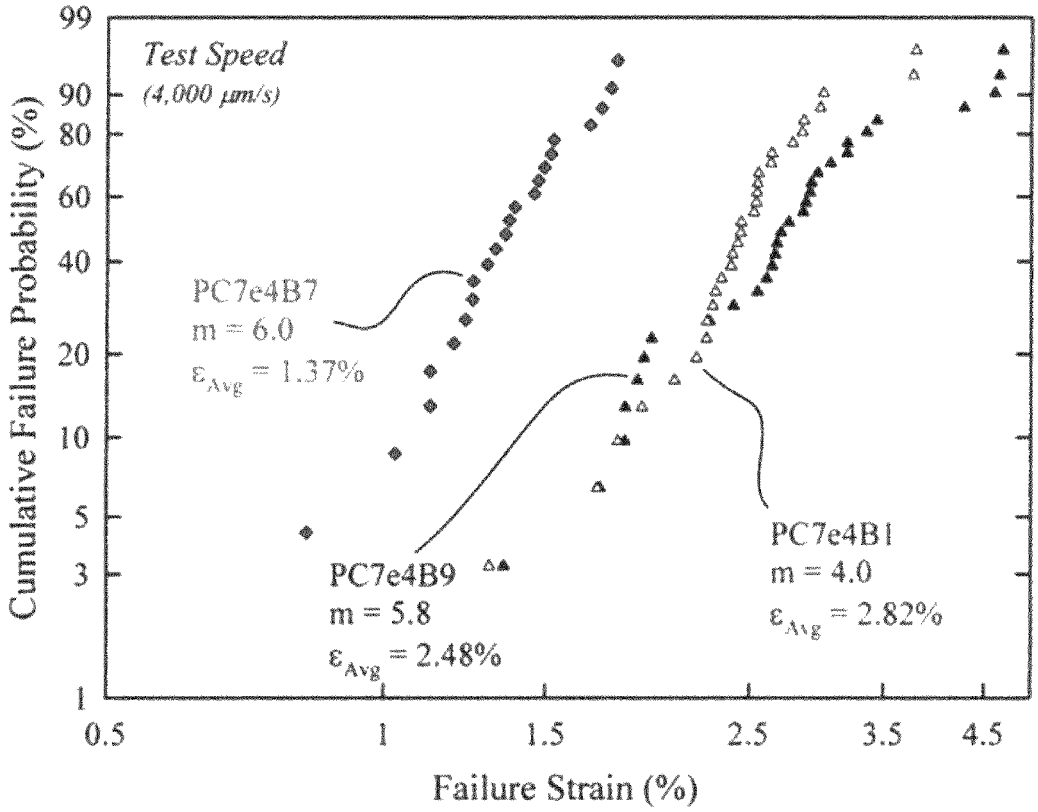
FIG. 13 illustrates bend test data showing the cumulative failure probability as a function of failure strain for the ALLOY 1B series alloys melt-spun at 16 m/s.
Figure 14:
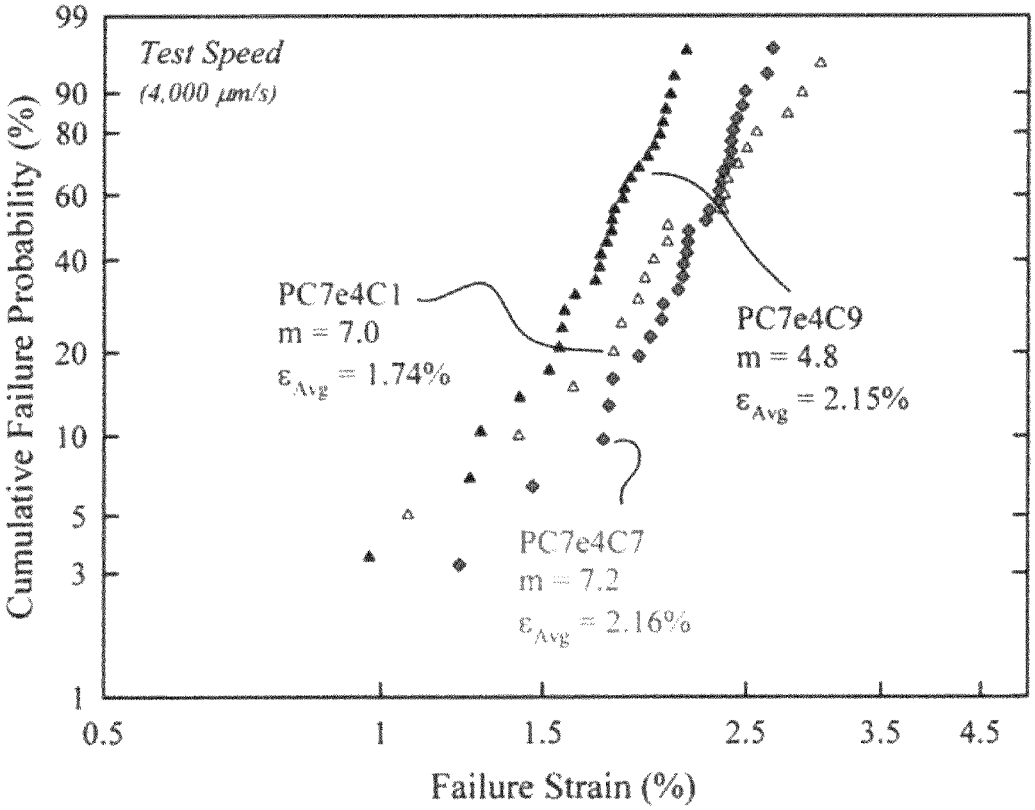
FIG. 14 illustrates bend test data showing the cumulative failure probability as a function of failure strain for the ALLOY 1C series alloys melt-spun at 16 m/s.

In FIGS. 12, 13, and 14, two point bend results are shown giving the cumulative failure probability as a function of failure strain for the ALLOY 1A series, ALLOY 1B series, and ALLOY 1C alloys respectively, which were melt-spun at 16 m/s. Note that every data point in these Figures represents a separate bend test and for each sample, 17 to 25 measurements were done. In Table 11, the results on these 16 m/s bend test measurements are tabulated including Young's Modulus (GPA and psi), failure strength (GPA and psi), Weibull Modulus, average strain (%), and maximum strain (%). Note that for the ALLOY 7 sample that all ribbons tested did not break during the test so failure strength could not be measured. The Young's Modulus calculation and estimation was described in the previous nanoindentation testing section. The failure strength calculated according to Equation #3 is found to be relatively high and ranges from 2.24 to 5.88 GPa (325,000 to 855,000 psi). The Weibull Modulus was found to vary from 2.43 to 10.1 indicating the presence of macrodefects in some of the ribbons causing premature failure. The average strain in percent was calculated based on the sample set that broke during two-point bend testing. The average strain ranged from 1.37 to 97%, in the case of the ALLOY 7 sample that did not break during the testing. The maximum strain in percent was the maximum strain found during bending for the samples that broke or 97% for the samples that did not break during testing. The maximum strain was found to vary from 3.4% to 97%.

TABLE 11

| Results of Bend Testing on Thin Ribbons (16 m/s) | | | | | | | |
|---|---|---|---|---|---|---|---|
| Alloy | Youngs Modulus (GPa) | Failure Strength (GPa) | Youngs Modulus (psi) | Failure Strength (psi) | Weibull Modulus | Avg Strain (%)** | Max Strain (%) |
| ALLOY 1 | 128.9 | 2.42 | 18,695,360 | 350,991 | 4.60 | 1.95 | 97 |
| ALLOY 2 | 125* | 3.80 | 18,129,713 | 551,143 | 2.43 | 2.03 | 97 |
| ALLOY 3 | 118.7 | 2.84 | 17,215,975 | 411,907 | 6.01 | 1.97 | 97 |
| ALLOY 4 | 125* | 3.22 | 18,129,713 | 467,021 | 4.98 | 2.00 | 97 |

TABLE 11-continued

Results of Bend Testing on Thin Ribbons (16 m/s)

| Alloy | Youngs Modulus (GPa) | Failure Strength (GPa) | Youngs Modulus (psi) | Failure Strength (psi) | Weibull Modulus | Avg Strain (%)** | Max Strain (%) |
|---|---|---|---|---|---|---|---|
| ALLOY 5 | 125* | 3.03 | 18,129,713 | 439,464 | 2.98 | 1.27 | 3.4 |
| ALLOY 6 | 125* | 5.88 | 18,129,713 | 852,822 | 3.97 | 2.82 | 4.7 |
| ALLOY 7 | 134.1 | — | 19,452,891 | — | — | 97 | 97 |
| ALLOY 8 | 125* | 2.24 | 18,129,713 | 324,884 | 5.99 | 1.37 | 97 |
| ALLOY 9 | 125* | 4.73 | 18,129,713 | 686,028 | 5.77 | 2.48 | 3.78 |
| ALLOY 10 | 125* | 2.68 | 18,129,713 | 388,701 | 6.93 | 1.74 | 97 |
| ALLOY 11 | 133.0 | 2.67 | 19,292,915 | 385,800 | 10.1 | 1.87 | 97 |
| ALLOY 12 | 125* | 3.33 | 18,129,713 | 482,976 | 7.21 | 2.16 | 97 |
| ALLOY 13 | 125* | 3.76 | 18,129,713 | 545,342 | 4.81 | 2.15 | 18.2 |

*assumed value

**for samples that broke during bend testing

Figure 15:
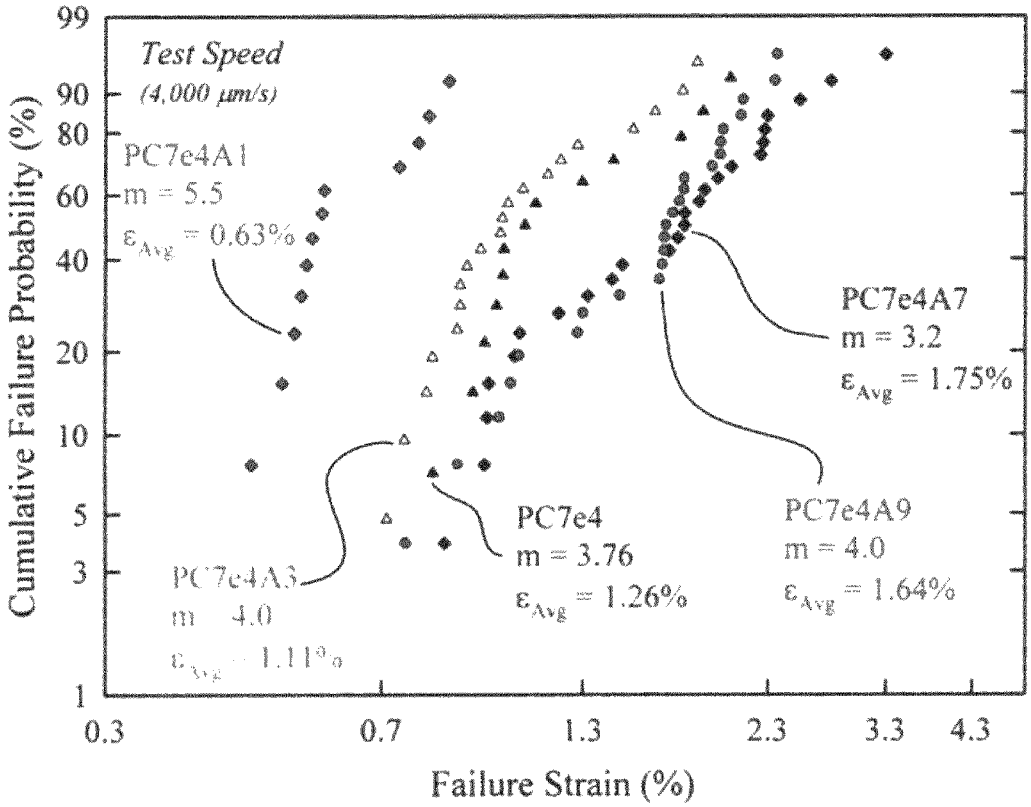
FIG. 15 illustrates bend test data showing the cumulative failure probability as a function of failure strain for the ALLOY 1A series alloys melt-spun at 10.5 m/s.
Figure 16:
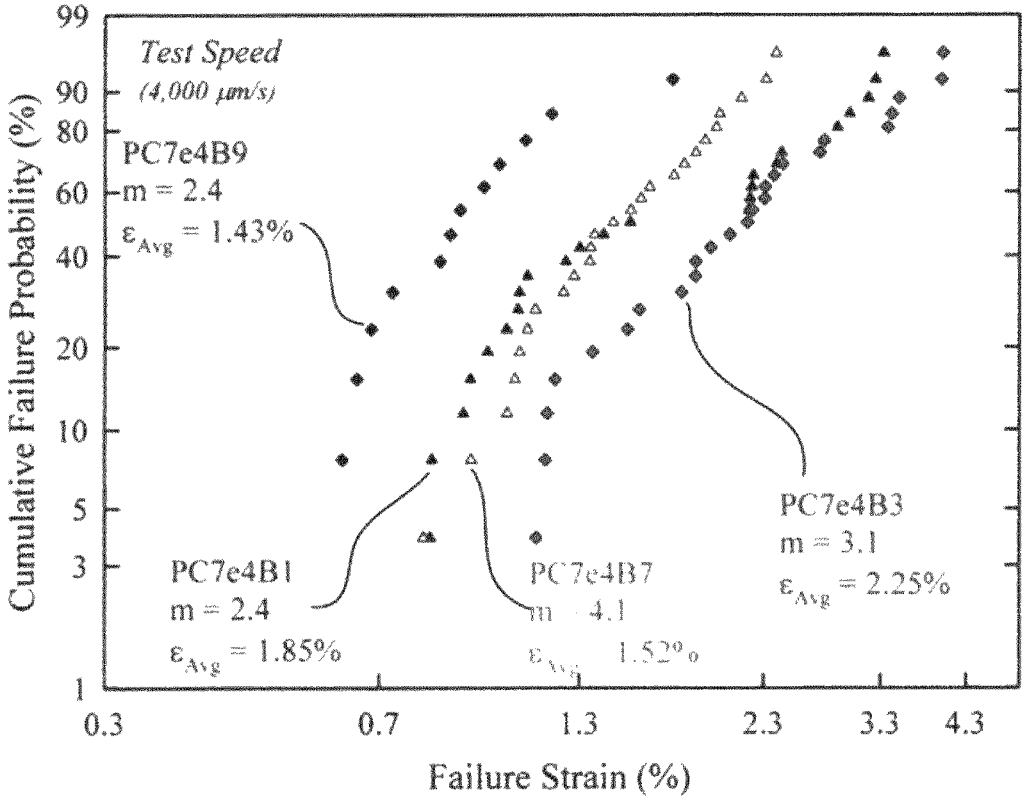
FIG. 16 illustrates bend test data showing the cumulative failure probability as a function of failure strain for the ALLOY 1B series alloys melt-spun at 10.5 m/s.
Figure 17:
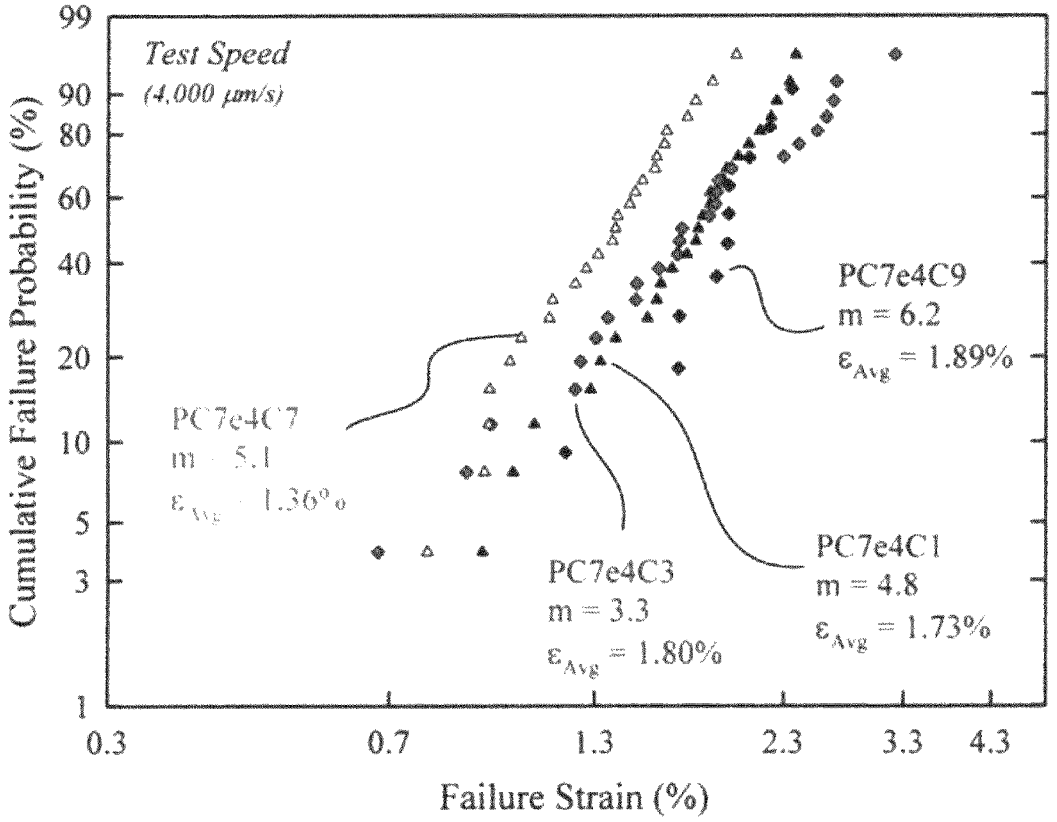
FIG. 17 illustrates bend test data showing the cumulative failure probability as a function of failure strain for the ALLOY 1C series alloys melt-spun at 10.5 m/s.

In FIGS. 15, 16, and 17, two point bend results are shown giving the cumulative failure probability as a function of failure strain for the ALLOY 1A series, ALLOY 1B series, and ALLOY 1C alloys respectively which have been melt-spun at 10.5 m/s. Note that every data point in these Figures represents a separate bend test and for each sample, 17 to 25 measurements were done. In Table 12, the results on these 10.5 m/s bend test measurements are tabulated including Young's Modulus (GPA and psi), failure strength (GPA and psi), Weibull Modulus, average strain (%), and maximum strain (%). The Young's Modulus calculation and estimation was described in the previous nanoindentation testing section. The failure strength calculated according to Equation #3 is found to be very high and ranges from 1.08 to 5.36 GPa (160,000 to 780,000 psi). The Weibull Modulus was found to vary from 2.42 to 6.24 indicating the presence of macrodefects in some of the ribbons causing premature failure. The average strain in percent ranged from 0.63 to 2.25% and the maximum strain in percent was found to vary from 0.86% to 4.00%.

TABLE 12

Results of Bend Testing on Thick Ribbons (10.5 m/s)

| Alloy | Youngs Modulus (GPa) | Failure Strength (GPa) | Youngs Modulus (psi) | Failure Strength (psi) | Weibull Modulus | Avg Strain (%)** | Max Strain (%) |
|---|---|---|---|---|---|---|---|
| ALLOY 1 | 128.9 | 2.64 | 18,695,360 | 382,900 | 3.76 | 1.26 | 2.05 |
| ALLOY 2 | 125* | 1.08 | 18,129,712 | 156,641 | 5.51 | 0.63 | 0.86 |
| ALLOY 3 | 118.7 | 2.31 | 17,215,975 | 335,037 | 4.04 | 1.11 | 1.85 |
| ALLOY 4 | 125* | 4.13 | 18,129,712 | 599,006 | 3.22 | 1.75 | 3.30 |
| ALLOY 5 | 125* | 2.96 | 18,129,712 | 429,312 | 4.00 | 1.64 | 2.37 |
| ALLOY 6 | 125* | 4.16 | 18,129,712 | 603,357 | 2.35 | 1.85 | 3.33 |
| ALLOY 7 | 134.1 | 5.36 | 19,449,556 | 777,402 | 3.09 | 2.25 | 4.00 |
| ALLOY 8 | 125* | 2.99 | 18,129,712 | 433,663 | 4.12 | 1.52 | 2.39 |
| ALLOY 9 | 125* | 2.17 | 18,129,712 | 314,732 | 2.42 | 1.43 | 1.73 |
| ALLOY 10 | 125* | 2.98 | 18,129,712 | 432,212 | 4.84 | 1.73 | 2.38 |
| ALLOY 11 | 133.0 | 2.66 | 19,290,014 | 385,800 | 3.28 | 1.80 | 3.21 |
| ALLOY 12 | 125* | 2.49 | 18,129,712 | 361,144 | 5.07 | 1.36 | 1.99 |
| ALLOY 13 | 125* | 2.94 | 18,129,712 | 426,411 | 6.24 | 1.89 | 2.35 |

*assumed value

**for samples that broke during bend testing

Commercial Product Forms

Due to the combination of properties of the alloys in Table 1, the potential or expected applications for thin products developed from these alloys may be contemplated. Due to specific combination of favorable properties, which includes the relatively high tensile strength and hardness coupled with significant tensile elongation and high elasticity, it is contemplated that a number of thin product forms would be viable including fibers, ribbons, foils, and microwires.

Reference to thin product forms may be understood as less than or equal to 0.25 mm in thickness or less than or equal to 0.25 mm in cross-sectional diameter. Accordingly, the range of thickness may be form 0.01 mm to 0.25 mm, including all values and increments therein, in 0.01 mm increments. The thin product forms may include, e.g., sheet, foil, ribbon, fiber, powders and microwire. One may utilize the Taylor-Ulitovsky wire making process. The Taylor-Ulitovsky method is a method for preparing a wire material by melting a glass tube filled with a metal material by high-frequency heating, followed by rapid solidification. Details on the preparation method are described in A. V. Ulitovsky, "Method of Continuous Fabrication of Microwires Coated by Glass", USSR patent, No. 128427 (Mar. 9, 1950), or G F. Taylor, Physical Review, Vol. 23 (1924) p. 655.

The thin product forms noted above may be specifically employed for structural/reinforcement type applications, including, but not limited to composite reinforcement (e.g. placement of the thin product form in a selected polymeric resin, including either thermoplastic and non-crosslinked polymers and/or thermoset or crosslinked type resin). The thin product forms (fibers and/or ribbons) may also be used in concrete reinforcement. In addition, the thin product forms may be used for wire saw cutting, weaving for ballistic resistance applications and foil for ballistic backing applications.

The thickness of the materials produced may preferably be in the sub-range of 0.02 to 0.15 mm. In Table 13, a list of commercial processing techniques, their material form, typical thickness, and estimated cooling rates are shown. As indicated, the range of thickness possible in these commercial products is well within the capabilities of the alloys in Table 1. Thus, it is contemplated that ductile wires, thin sheets (foils), and fibers may be produced by these and other related commercial processing methods.

TABLE 13

Summary of Existing Commercial Processing Approaches

| Process | Material Form | Typical Thickness | Cooling Rate |
|---|---|---|---|
| Melt-Spinning/ Jet Casting Commercial Process | Ribbon | 0.02 to 0.20 mm | $\sim 10^4$ to $\sim 10^6$ K/s |
| Wire Casting Process | Circular cross section wire | 0.3 to 0.15 mm | $\sim 10^5$ to $\sim 10^6$ K/s |
| Taylor-Ulitovsky Wire Casting Process | Round wire | 0.02 to 0.10 mm | $\sim 10^3$ to $\sim 10^6$ K/s |
| Planar Flow Casting Sheet Process | Thin sheet/foil | 0.02 to 0.08 mm | $\sim 10^4$ to $\sim 10^6$ K/s |
| Gas/Centrifigal Atomization | Spherical powder | 0.01 to 0.250 | $\sim 10^4$ to $\sim 10^6$ K/s |

* Range of thickness where ductile response can be maintained

Example #1

Figure 18:
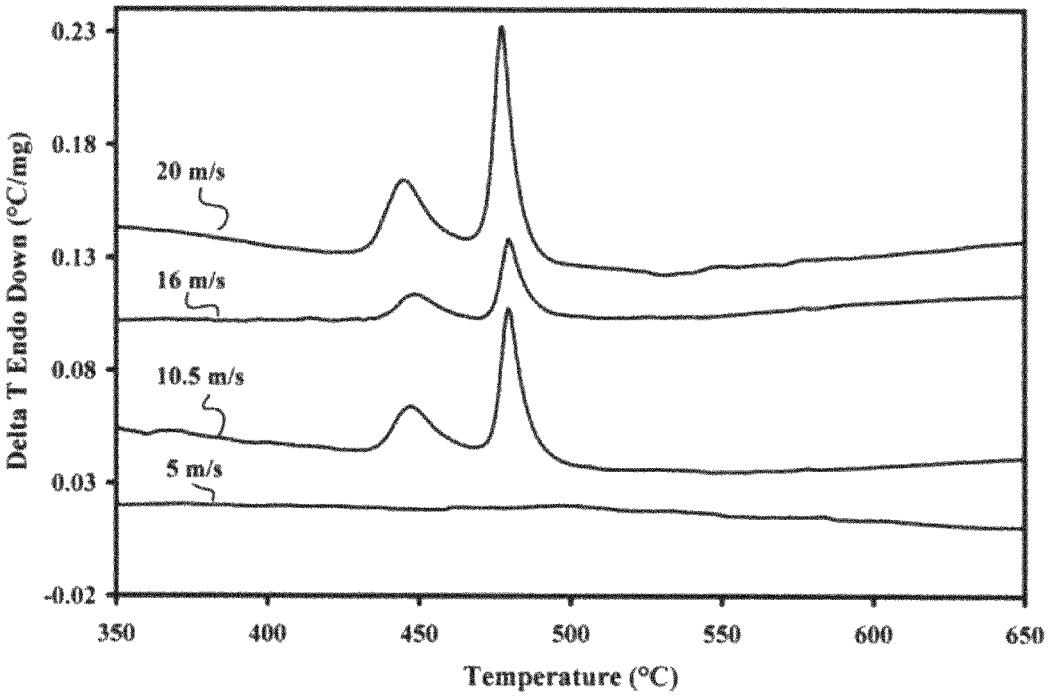
FIG. 18 illustrates DTA curves of the ALLOY 11 alloys melt-spun at a wheel tangential velocity of 16 m/s, 10.5 m/s and 5 m/s.

Using high purity elements, three fifteen gram charges of the ALLOY 11 chemistry was weighed out according to the atomic ratio's in Table 1. The mixture of elements was placed onto a copper hearth and arc-melted into an ingot using ultra-high purity argon as a cover gas. After mixing, the resulting ingots were cast into a figure shape appropriate for melt-spinning. The cast fingers of ALLOY 11 were then placed into a quartz crucible with a hole diameter nominally at 0.81 mm. The ingots were heated up by RF induction and then ejected onto a rapidly moving 245 mm copper wheel traveling at wheel tangential velocity of 16 m/s, 10.5 m/s, and 5 m/s. DTA/DSC analysis of the as-solidified ribbons were done at a heating rate of 10° C./min and were heated up from room temperature to either 900° C. or 1350° C. DTA curves of the three ribbon samples are shown in FIG. 18 and their corresponding DSC data for the glass crystallization peaks are shown in Table 14. As shown, by changing the wheel tangential velocity, the amount of glass and corresponding crystallinity can be changed from a very high (approaching 100%) percent glass at 20 m/s to a very low value (approaching 0%) at 5 m/s.

TABLE 14

DSC Results on ALLOY 11 Ribbons

| Wheel Speed (m/s) | Glass Present | Peak #1 Onset (° C.) | Peak #1 Peak (° C.) | Enthalpy (−J/g) | Peak #2 Onset (° C.) | Peak #2 Peak (° C.) | Enthalpy (−J/g) |
|---|---|---|---|---|---|---|---|
| 20 | Yes | 434 | 445 | 51.8 | 473 | 478 | 84.6 |
| 16 | Yes | 439 | 449 | 13.0 | 475 | 480 | 24.6 |
| 10.5 | Yes | 437 | 447 | 30.6 | 475 | 480 | 53.8 |
| 5 | No | | | | | | |

Example #2

Figure 19:
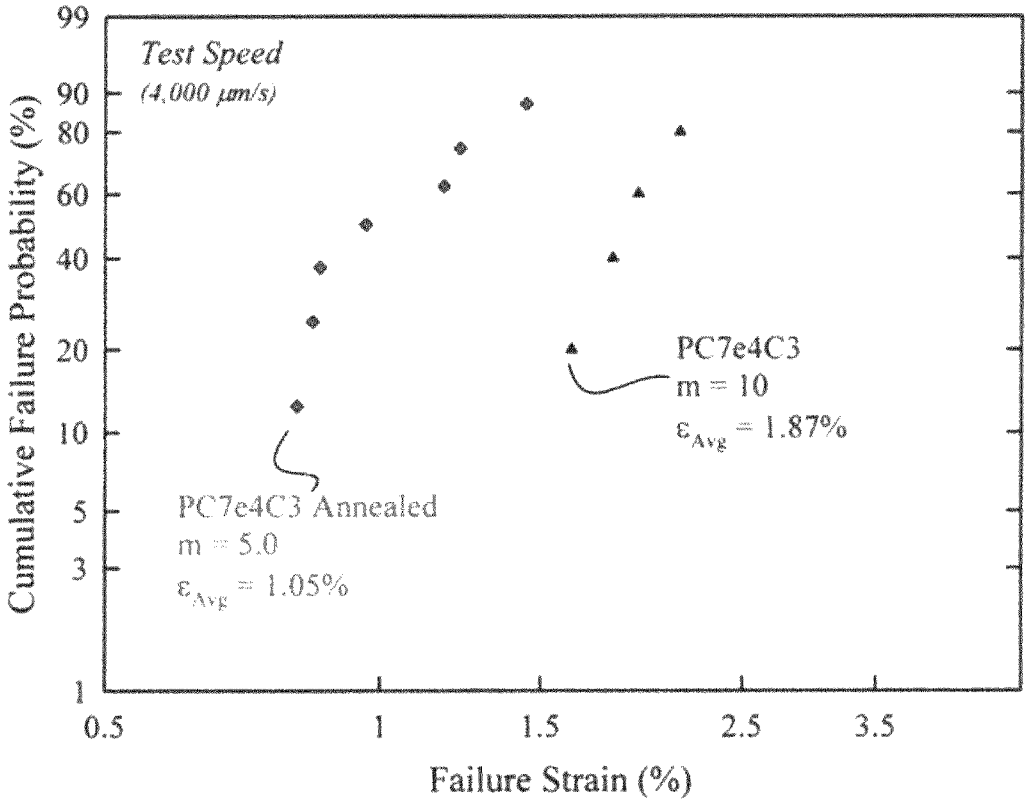
FIG. 19 illustrates bend test data showing the cumulative failure probability as a function of failure strain for the ALLOY 11 series alloys melt-spun at 16 m/s and annealed at 450° C. for 3 hour.
Figure 20:
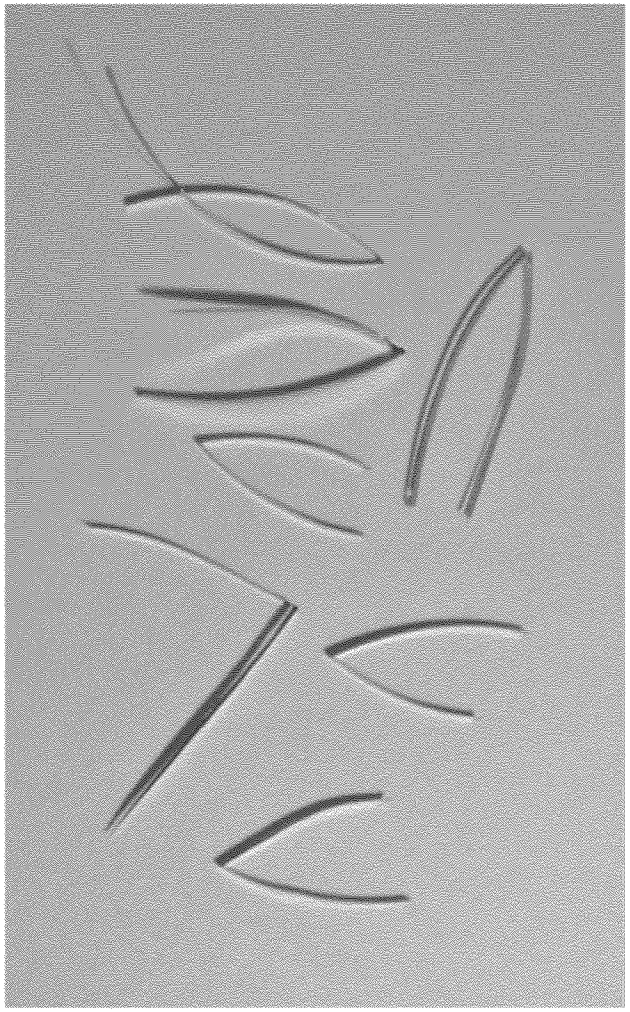
FIG. 20 illustrates examples of ALLOY 11 ribbon samples which have been bent 180° during two point bending without breaking.

Using high purity elements, a fifteen gram charge of the ALLOY 11 chemistry was weighed out according to the atomic ratio's in Table 1. The mixture of elements was placed onto a copper hearth and arc-melted into an ingot using ultra-high purity argon as a cover gas. After mixing, the resulting ingot was cast into a figure shape appropriate for melt-spinning. The cast finger of ALLOY 11 was then placed into a quartz crucible with a hole diameter nominally at 0.81 mm. The ingot was heated up by RF induction and then ejected onto a rapidly moving 245 mm copper wheel traveling at a wheel tangential velocity of 16 m/s. The ribbons that were produced were then annealed in a vacuum tube furnace at 450° C. for 3 hours. Samples of ALLOY 11 in both the as-spun and annealed condition were tested using two point bending. The results of two-point bending are shown in FIG. 19 and tabulated in Table 15. Note that for the as-sprayed samples that the majority of these samples did not break during testing and folded completely back against itself as shown in FIG. 20. Note that the lower limit of the two point bend machine was set at 120 microns and the ALLOY 11 measured ribbon thickness was ~53 microns. Thus, when the ribbon was folded completely upon itself it underwent a ~97% strain on the side in tension. Note that after the particular heat treatment chosen, the failure strength and strain for the ALLOY 11 sample both decreased.

TABLE 15

Results of Bend Testing on ALLOY 11 in the As-Spun and Annealed Conditions

| Alloy | Condition | Youngs Modulus (GPa) | Failure Strength (GPa) | Youngs Modulus (psi) | Failure Strength (psi) | Weibull Modulus | Avg Strain (%)* | Max Strain (%) |
|---|---|---|---|---|---|---|---|---|
| ALLOY 11 | As-Spun | 133.0 | 2.67 | 19,292,915 | 385,800 | 10.1 | 1.87 | 97 |
| ALLOY 11 | Annealed | 133.0 | 2.25 | 19,292,915 | 325,112 | 4.9 | 1.05 | 1.47 |

*for samples that broke during bend testing

Example #3

Figure 21:
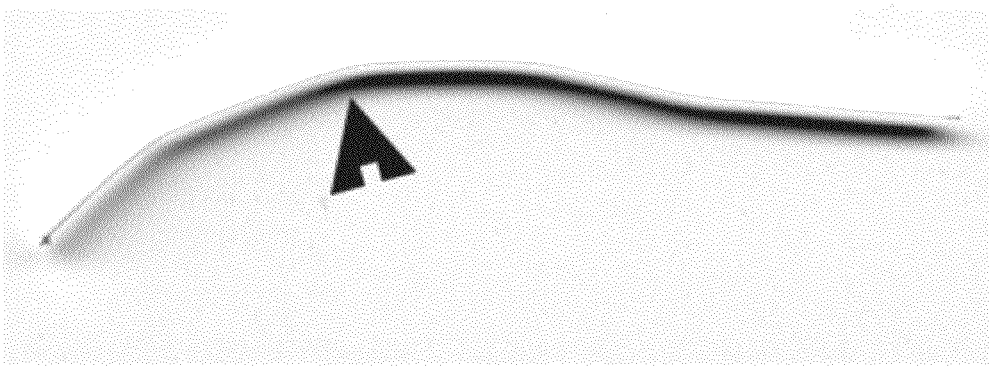
FIG. 21 illustrates an example of a ALLOY 11 ribbon sample bent ~2.5% strain with a kink appearing (see arrow) indicating the onset of plastic deformation.

Ribbon samples of ALLOY 11 melt-spun at 16 m/s and prepared according to the methodology in Example #1 were utilized for additional two point bend testing. By opening and closing the faceplates and visually inspecting the samples, it was possible to visually determine the onset of plastic deformation to look for permanent deformation. When the samples were bent at 2.4% strain and below, no permanent deformation was observed on the ribbon as it appeared to completely spring back. While deforming the ribbon from 2.4% to 2.6%, permanent deformation was observed with the ribbon containing a slight kink after testing (see arrow in FIG. 21). This example indicates that the materials may exhibit a relatively high elasticity, which may be consistent with their metallic glass nature. Note that conventional crystalline materials would generally exhibit an elastic limit below 0.5%.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming a ductile metallic material comprising:

providing a glass forming iron based metallic alloy comprising 45 to 70 at % iron, nickel and cobalt both being present with a total amount of nickel and cobalt in the range of 7 at % to 50 at %, and boron, carbon and silicon each being present with a total amount of boron, carbon and silicon in the range of 8.3 at % to 35 at %, wherein said atomic percents are selected to provide at least 95 atomic percent for a given alloy;

melting said glass forming iron based metallic alloy; and forming said glass forming alloy and cooling said alloy at a rate of about $10^2$ to $10^6$ K/s forming a material comprising a mixed structure of metallic glass and a nanocrystalline material having a mean grain size of 1 nm to 500 nm; wherein said material exhibits a strain of greater than 0.5%, a failure strength in the range of 1 GPa to 5.9 GPa and a Vickers hardness (HV300) of 9 GPa to 15 GPa.

2. The method of claim 1 wherein said glass forming iron based metallic alloy comprises 45 at % to 70 at % iron, 10 at % to 30 at % Ni, 7 at % to 15 at % cobalt, 7 at % to 25 at % B, 1 at % to 6 at % carbon and 0.3 at % to 2 at % silicon.

3. The method of claim 1 wherein said glass forming iron based metallic alloy comprises 52 at % to 60 at % iron, 13 at % to 18 at % nickel, 8 at % to 12 at % cobalt, 10 at % to 17 at % boron, 3 at % to 6 at % C and 0.3 at % to 0.7 at % silicon.

4. The method of any claim 1 wherein said material exhibits at least one glass to crystalline transformation onset in the range of 350° C. to 675° C., measured by DSC at a heating rate of 10° C./min.

5. The method of claim 1 wherein said material exhibits at least one glass to crystalline transformation peak in the range of 350° C. to 700° C., measured by DSC at a heating rate of 10° C./min.

6. The method of claim 1 wherein said material exhibits at least one melting onset at a temperature in the range of 1000° C. to 1250° C., measured by DSC at a heating rate of 10° C./min.

7. The method of claim 1 wherein said material exhibits at least one melting peak at a temperature in the range of 1000° C. to 1250° C., measured by DSC at a heating rate of 10° C./min.

8. The method of any claim 1 wherein providing a glass forming alloy comprising blending feedstocks and melting said feedstocks to combine said feedstocks into said glass forming iron based metallic alloy.

9. The method of any claim 1 wherein said material exhibits an elasticity of up to 3%.

* * * * *

UNITED STATES PATENT AND TRADEMARK OFFICE

CERTIFICATE OF CORRECTION

PATENT NO. : 8,317,949 B2
APPLICATION NO. : 12/485843
DATED : November 27, 2012
INVENTOR(S) : Daniel James Branagan et al.

It is certified that error appears in the above-identified patent and that said Letters Patent is hereby corrected as shown below:

On Title page, field (74), in "Attorney, Agent, or Firm", in column 2, line 1, delete "Tucke," and insert -- Tucker, --, therefor.

In column 20, line 9, in claim 4, after "of" delete "any".

In column 20, line 25, in claim 8, after "of" delete "any".

In column 20, line 29, in claim 9, after "of" delete "any".

Signed and Sealed this
Fifth Day of February, 2013

Teresa Stanek Rea
*Acting Director of the United States Patent and Trademark Office*